US008373116B2

(12) United States Patent
Oleschuk et al.

(10) Patent No.: US 8,373,116 B2
(45) Date of Patent: Feb. 12, 2013

(54) MULTI-CHANNEL ELECTROSPRAY EMITTER

(75) Inventors: Richard D. Oleschuk, Kingston (CA); Graham Gibson, Kingston (CA); Ramin Wright, Kingston (CA)

(73) Assignee: Queen's University at Kingston, Kingston, ON (CA)

( * ) Notice: Subject to any disclaimer, the term of this patent is extended or adjusted under 35 U.S.C. 154(b) by 0 days.

(21) Appl. No.: 12/887,252

(22) Filed: Sep. 21, 2010

(65) Prior Publication Data

US 2011/0101122 A1 May 5, 2011

Related U.S. Application Data

(60) Provisional application No. 61/244,325, filed on Sep. 21, 2009.

(51) Int. Cl.
*B05B 5/025* (2006.01)
*B05D 3/10* (2006.01)

(52) U.S. Cl. ..... 250/288; 239/3; 239/696

(58) Field of Classification Search ..... 250/288, 250/281–282; 216/56; 239/3, 696
See application file for complete search history.

(56) References Cited

U.S. PATENT DOCUMENTS

| | | | | |
|---|---|---|---|---|
| 6,301,420 | B1 | 10/2001 | Greenaway et al. | |
| 6,710,335 | B2 | 3/2004 | Ellson et al. | |
| 7,105,810 | B2 | 9/2006 | Kameoka et al. | |
| 7,105,812 | B2 * | 9/2006 | Zhao et al. | 250/288 |
| 7,108,775 | B2 | 9/2006 | Bahatt et al. | |
| 7,208,727 | B2 | 4/2007 | Fedorov et al. | |
| 8,022,361 | B2 * | 9/2011 | Wang et al. | 250/288 |
| 2002/0031758 | A1 * | 3/2002 | McLeod et al. | 435/4 |
| 2006/0027744 | A1 * | 2/2006 | Stults et al. | 250/288 |
| 2006/0115971 | A1 * | 6/2006 | Bau et al. | 438/591 |
| 2006/0192107 | A1 * | 8/2006 | DeVoe et al. | 250/288 |
| 2006/0214099 | A1 | 9/2006 | Oleschuk et al. | |
| 2009/0230296 | A1 * | 9/2009 | Kelly et al. | 250/281 |
| 2009/0283671 | A1 * | 11/2009 | Oleschuk | 250/282 |
| 2010/0001181 | A1 * | 1/2010 | Moini | 250/282 |
| 2010/0075428 | A1 * | 3/2010 | Wang et al. | 436/86 |
| 2010/0193683 | A1 * | 8/2010 | Marto | 250/288 |
| 2011/0101122 | A1 * | 5/2011 | Oleschuk et al. | 239/3 |
| 2011/0107822 | A1 * | 5/2011 | Bunner et al. | 73/61.52 |

FOREIGN PATENT DOCUMENTS

| | | | |
|---|---|---|---|
| WO | WO 2007/115165 | A2 | 10/2007 |
| WO | WO 2007/127631 | A2 | 11/2007 |
| WO | WO 2009/005476 | A1 | 1/2009 |

OTHER PUBLICATIONS

Su, Shuqin, Development and Application of Non-Tapered Electrospray Emitters for Nano-ESI Mass Spectrometry, doctoral thesis, 2008.*

Gibson, G., et al., "Nanoelectrospray Emitters: Trends and Perspective," Mass Spectrometry Reviews, vol. 28, 918-936 (2009).

(Continued)

*Primary Examiner* — David A Vanore
*Assistant Examiner* — Wyatt Stoffa
(74) *Attorney, Agent, or Firm* — Stephen J. Scribner

(57) ABSTRACT

Provided is a multi-channel electrospray emitter. The emitter includes a plurality of separate or distinct capillaries, each capillary being one channel and terminating in a nozzle, from which the analyte is sprayed. The nozzles may be raised above a face of the electrospray emitter. The multi-channel electrospray emitter may comprise a microstructured fiber. In one embodiment, the microstructured fiber may be a photonic crystal fiber.

10 Claims, 23 Drawing Sheets

OTHER PUBLICATIONS

Kelly, R., et at., "Chemically Etched Open Tubular and Monolithic Emitters for Nanoelectrospray Ionization Mass Spectrometry," Analytical Chemistry, vol. 78, No. 22, 7796-7801 (2006).
Kelly, R. et al., "Array of Chemically Etched Fused-Silica Emitters for Improving the Sensitivity and Quantitation of Electrospray Ionization Mass Spectrometry,"Analytical Chemistry, vol. 79, No. 11, 4192-4198 (2007).
Kelly, R. et al., "Nanoelectrospray Emitter Arrays Providing Interemitter Electric Field Uniformity" Analytical Chemistry, vol. 80, No. 14: 5660-5665 (2008).
Kelly, R. et al., "Capillary-Based Multi Nanoelectrospray Emitters: Improvements in Ion Transmission Efficiency and Implementation with Capillary Reversed-Phase LC-ESI-MS," Analytical Chemistry, vol. 80, No. 1: 143-149 (2008).
Kim, W. et al., "Microfabricated Monolithic Multinozzle Emitters for Nanoelectrospray Mass Spectrometry" Analytical Chemistry, vol. 79, No. 10: 3703-3707 (2007).
Su, S. et al., "Microstructured Photonic Fibers as Multichannel Electrospray Emitters," Analytical Chemistry, vol. 81, No. 17: 7281-7287 (2009).
Tang, K. et al., "Generation of Multiple Electrosprays Using Microfabricated Emitter Arrays for Improved Mass Spectrometric Sensitivity," Analytical Chemistry, vol. 73, No. 8: 1658-1663 (2001).
Koerner, T., et al., "Porous Polymer Monolith Assisted Electrospray," Analytical Chemistry, vol. 76, No. 21,: 6456-6460 (2004).
Koerner, T. et al., "Microsphere Entrapped Emitters for Sample Preconcentration and Electrospray Ionization Mass Spectrometry," Analytical Chemistry, vol. 79, No. 9: 3312-3319 (2007).
Luo, Q., et al., "On-Line 1D and 2D Porous Layer Open Tubular/LC-ESI-MS using . . . ", Analytical Chemistry, vol. 79, No. 16: 6174-6181 (2007).
Russell, Philip, "Photonic crystal fibers", Science 299: 358-362 (Jan. 17, 2003).
Sun, Yi, et al., "Faster and improved microchip electrophoresis using a capillary bundle", Electrophoresis 28: 4765-4768 (2007).
PCT International Search Report for International Application No. PCT/CA2009/000455 filed on Mar. 20, 2009.
PCT Written Opinion of the International Searching Authority for International Application No. PCT/CA2009/000455 filed on Mar. 20, 2009.

* cited by examiner a)

b)

c)

d)

e)

f)

MULTI-CHANNEL ELECTROSPRAY EMITTER

RELATED APPLICATIONS

This application claims the benefit of the filing date of U.S. Provisional Patent Application No. 61/244,325, filed on 21 Sep. 2009, the contents of which are incorporated herein by reference in their entirety.

FIELD OF THE INVENTION

This invention relates generally to electrospray emitters. In particular, this invention relates to a multi-channel nanoelectrospray emitter. More particularly, this invention relates to a multi-channel nanoelectrospray emitter based on a microstructured fibre, such as a photonic crystal fibre.

BACKGROUND OF THE INVENTION

Since its description by Dole[1] in the 1960's and demonstration by Fenn[2, 3] in 1984, electrospray ionization (ESI) has become the standard in the analysis of biomolecules, especially proteins and peptides. Generally, ESI is achieved by spraying a solution of analyte through a needle (called the emitter), across a potential difference. The resulting charged droplets undergo a series of fissions to form gaseous phase ions, which can be separated and detected by mass spectrometry (MS). The appeal of ESI for use with biomolecules is especially due to its ability to ionize large molecules without their destruction, unlike other ionization techniques such as electron impact.[4] The concomitant development in various mass spectrometer platforms (e.g., FT-ICR, QqQ, QTOF, etc.) that can be interfaced to ESI has also largely contributed to the development of the field in general.

An improvement over conventional ESI (flow rates>1 μL/min) has been the development of low flow ESI (flow rates<100 nL/min), also known as nanoelectrospray, described by Wilm and Mann in 1996.[9] The impetus for taking electrospray to nano levels has been largely due to the characteristic advantages born from formation of smaller droplets (reported to be approximately 180 nm). Such droplets have higher surface area to volume ratios than that of conventional ESI so that they can be easily desolvated, resulting in enhanced sensitivity. Furthermore, nanoelectrospray provides improved efficiency of ionization and ion transmission, resulting in low-level detection limits and an extended dynamic range, which is important in fields such as quantitative clinical proteomics and other areas of biomolecule analysis such as metabolomics and glycomics. The low flow rate used means one gets better sample economy (<5 μL), and moreover the improved desolvation at such low flow rates alleviates the need for a nebulizing gas. Nanoelectrospray has also been found to minimize greatly (and to eliminate at low nano flow rates (<50 nL/min)) ion suppression and matrix effects which can seriously plague regular ESI.[9-16]

Essential to the performance of nanoESI is a minimized sample stream for electrospray to the mass spectrometer. The interest in emitter development is mainly because of the pivotal role that emitters play in ensuring the success of nanoelectrospray. Indeed, the sensitivity, stability and reproducibility of nanoelectrospray are all highly dependent on the emitter characteristics. Wilm et al.[9] employed a pulled-glass substrate as an emitter, and demonstrated its improved electrospray performance at nano level flow rates. The format of such a tapered fused silica capillary with aperture<20 μm has been widely accepted as a commercial nano-emitter tip. However, such pulled-tip emitters have serious limitations, including their susceptibility to clogging due to the internal tapering and constricted aperture, limited range of possible flow rates, and poor reproducibility, impeding quantitation in fields such as proteomics.

To address such limitations associated with single aperture tapered emitters, interest has developed in multi-flowpath emitters. The use of multi-channel tips has been found to improve sensitivity significantly (sensitivity is proportional to the square root of the number of produced Taylor cones) and to extend the lifespan of emitter tips by reducing clogging. To develop multi-channel emitters, several groups including Smith[17, 18] and Wang[19] have borrowed techniques such as Micro Electro Mechanical Systems (MEMS), commonly employed in the electronics industry and recently used in the microfluidic chips industry, for emitter fabrication.[20-22] One of the emitters fabricated using MEMS technology has been branded the Microfabricated Monolithic Multinozzle emitter ($M^3$), which has attracted considerable interest within the proteomics industry.[19] Although promising due to its high reproducibility, throughput, and amenability for automation, this technique requires expensive equipment and clean room facilities, which results in a very expensive emitter.

Kelly et al.[17, 18] have reported a linear array of HF etched open tubular silica emitters. The linear array, which was made from multiple silica capillaries and required a custom made multi-capillary MS inlet, provided a significant increase in sensitivity and ion transmission efficiency. We have demonstrated improved ESI efficiency by employing emitters with a porous polymer monolith for nanoelectrospray.[23,24] As a progression from this, we recently developed a highly robust emitter by entrapping ODS spheres using a porous polymer network, creating an emitter with numerous pores, each behaving like an emitter, which radically reduces chances of clogging[25] (see also International Patent Application Publication No. WO 2006/092043). Nevertheless, none of these emitters offers the combination of ease of production and low cost, while meeting stringent performance requirements.

SUMMARY OF THE INVENTION

One aspect of the invention relates to an electrospray emitter comprising a plurality of channels, each channel including a capillary and a nozzle, wherein the nozzles are arranged in a 2-dimensional array. The capillaries may be arranged in a substantially parallel relationship within a fibre. In one embodiment the fibre may be a photonic crystal fibre (PCF).

Another aspect relates to an electrospray emitter comprising a plurality of channels, each channel including a capillary and a nozzle, wherein the capillaries are formed together within a single fibre.

Another aspect relates to an electrospray emitter comprising: a single fibre comprising a matrix material; a plurality of capillaries formed within the matrix material, the capillaries substantially aligned along a longitudinal axis of the fibre; and a plurality of nozzles at a first face of the fibre, each nozzle associated with a capillary.

The nozzles may be arranged in a substantially 2-dimensional array at the first face of the fibre. The capillaries may be arranged in a substantially parallel relationship within a fibre. The fibre may be a microstructured fibre. The fibre may be a photonic crystal fibre.

Another aspect relates to an electrospray emitter comprising: a body comprising a matrix material; a plurality of capillaries formed through the body; and a plurality of nozzles at a first face of the body, each nozzle associated with a capillary. The nozzles may be arranged in a substantially 2-dimensional array at the first face of the body. The capillaries may be arranged in a substantially parallel relationship within the body. In one embodiment, the emitter may comprise a microstructured fibre. In another embodiment, the emitter may comprise a photonic crystal fibre.

The diameter of each channel or capillary may be from 50 nm to 25 μm, from 500 nm to 10 μm, or from 1 μm to 8 μm, or from 4 μm to 5 μm. In one embodiment, the electrospray emitter lacks spaces, gaps, or voids between channels or capillaries.

The electrospray emitter may further comprise a functionalized portion associated with the nozzles. The functionalized portion may comprise an agent selected from a hydrophobic agent and a hydrophilic agent. The functionalized portion may comprise a hydrophobic agent. The functionalized portion may comprise at least one agent selected from perfluorooctylchlorosilane, octadecylsilane, chlorotrimethylsilane (CTMS), and γ-methacryloxypropyltrimethoxysilane (γ-MAPS). The functionalized portion may comprise a hydrophilic agent. The functionalized portion may comprise acrylamido-2-methyl-1-propane sulfonic acid.

The electrospray emitter may be used with a mass spectrometer.

Another aspect of the invention relates to the use of a microstructured fibre as an electrospray emitter. The microstructured fibre may comprise a matrix material; a plurality of capillaries formed within the matrix material, the capillaries substantially aligned along a longitudinal axis of the fibre; and a plurality of nozzles at a first face of the fibre, each nozzle associated with a capillary. The nozzles may be arranged in a substantially 2-dimensional array at the first face of the fibre. The capillaries may be arranged in a substantially parallel relationship within the fibre. In one embodiment, the microstructured fibre may be a photonic crystal fibre.

Another aspect of the invention relates to a system for electrospray ionization of molecules, comprising an electrospray emitter as described above. The system may further comprise a mass spectrometer.

Another aspect of the invention relates to a method for producing an electrospray of a solution, comprising providing an electrospray emitter having a plurality of channels, each channel including a capillary and a nozzle, wherein the nozzles are arranged in a 2-dimensional array. In one embodiment, the emitter may comprise a PCF.

Another aspect relates to a method for producing an electrospray of a solution, comprising: providing an electrospray emitter including: a single fibre comprising a matrix material; a plurality of capillaries formed within the matrix material, the capillaries substantially aligned along a longitudinal axis of the fibre; and a plurality of nozzles at a first face of the fibre, each nozzle associated with a capillary; applying a potential difference to the electrospray emitter; and applying the solution to the electrospray emitter so as to produce an electrospray.

The method may include arranging the nozzles in a 2-dimensional array. The emitter may comprise a microstructured fibre. The emitter may comprise a photonic crystal fibre.

The method may further comprise modifying at least a portion of the nozzles of the emitter by attaching a functionalizing agent thereto. The functionalizing agent may comprise an agent selected from a hydrophobic agent and a hydrophilic agent. The functionalizing agent may comprise a hydrophobic agent. The functionalizing agent may comprise at least one agent selected from perfluorooctylchlorosilane, octadecylsilane, chlorotrimethylsilane (CTMS), and γ-methacryloxypropyltrimethoxysilane (γ-MAPS). The functionalizing agent may comprise a hydrophilic agent. The functionalizing agent may comprise acrylamido-2-methyl-1-propane sulfonic acid.

The electrospray may be a nanoelectrospray. In one embodiment the nanoelectrospray may be in the range of about 20 nL/min to about 1000 nL/min. In other embodiments the nanoelectrospray may be in the range of about 5 nL/min to about 5000 nL/min, about 5 nL/min to about 50000 nL/min, or about 10 nL/min to about 1000 nL/min.

The method may further comprise using the electrospray emitter with a mass spectrometer, wherein the solution comprises an analyte.

Another aspect provides an electrospray emitter comprising: a body comprising a matrix material; a plurality of capillaries formed through the matrix material; a coating material disposed on inside walls of the capillaries; and a plurality of nozzles at a first face of the body, each nozzle associated with a capillary. The number of nozzles may be from 2 to about 200, or from 3 to 20.

Also described herein is a method for preparing an electrospray emitter, comprising: providing an electrospray emitter body comprising a matrix material having a plurality of capillaries formed through the matrix material, wherein an open end of each capillary is exposed on a face of the body; disposing a coating material on inside walls of the capillaries; and removing matrix material from the face of the electrospray emitter so as to reveal the coating material elevated above the face; wherein the coating material elevated above the face is a plurality of nozzles, each nozzle corresponding to a capillary. The method may include etching the matrix material to remove matrix material from the face of the electrospray emitter. The number of nozzles may be from 2 to about 200, or from 3 to 20.

Also described herein is a method comprising using an electrospray emitter as described herein with a mass spectrometer and a solution comprising an analyte.

Also described herein is a method for producing an electrospray of a solution, comprising: applying the solution to an electrospray emitter as described herein; and applying a potential difference to the electrospray emitter; wherein an electrospray of the solution is produced. The electrospray may be a multi-electrospray.

In the above aspects and embodiments, at least a portion of the nozzles that are raised above the matrix material of the face of the emitter may substantially comprise the coating material.

Another aspect provides a method for producing an electrospray of a solution, comprising: providing an electrospray emitter including: a body comprising a matrix material; a plurality of capillaries formed through the matrix material; a coating material disposed on inside walls of the capillaries; and a plurality of nozzles at a first face of the body, each nozzle associated with a capillary; applying a potential difference to the electrospray emitter; and applying the solution to the electrospray emitter so as to produce an electrospray.

The method may comprise etching the matrix material to expose a portion of the coating material, such that the nozzles are raised above the matrix material of the emitter. Etching may include using an etchant, wherein the etchant has a fluoride ($F^-$), selected from HF (aq), NaF (aq), KF (aq), and $NH_4F$ (aq), or a bifluoride ($HF_2^-$) selected from $(NH_4)(HF_2)$ (aq) and $K(HF_2)$, wherein any cation may be used Another aspect provides a method for producing an electrospray emitter, comprising: coating inside walls of capillaries of a microstructured fibre (MSF) with a polymeric material that resists an etchant; and etching matrix material from a face of the MSF to expose the polymeric material above the matrix material; wherein exposed portions of the polymeric material are nozzles of the emitter.

In the above aspects, the coating material disposed on inside walls of the capillaries may be a polymer. The polymer may be a divinylbenzene (DVB) material selected from polystyrene-divinylbenzene, a DVB homopolymer, DVB-vinylpyridine, DVB-ethylene glycol dimethacrylate (EDMA), and DVB-acrylonitrile, or a polymer selected from methyl, butyl, or stearyl methacrylate-EDMA, polyacrylamide-bisacrylamide, cyclodextrin, polyurethane, epoxy, polyvinyl alcohol (PVA), polyvinyl pyrrolidone (PVP), a charged polymer, and polyethyleneimine (PEI).

BRIEF DESCRIPTION OF THE DRAWINGS

The invention will be described below, by way of example, with reference to the accompanying drawings, wherein.

DETAILED DESCRIPTION OF EMBODIMENTS

One aspect of the invention relates to a multi-channel nanoelectrospray emitter including a plurality of separate or distinct capillaries, each capillary being one channel and terminating in an opening, referred to herein as a "nozzle", from which the analyte is dispersed or sprayed. In general, a multi-channel nanoelectrospray emitter as exemplified by the embodiments described herein is easily produced, inexpensive, long lasting, and able to resist clogging.

In one embodiment, the capillaries may be bundled or grouped together in a substantially parallel arrangement.

In another embodiment, the electrospray emitter may include a body made of a matrix material, a plurality of capillaries formed through the matrix material of the body; and a plurality of nozzles at a first end of the body, each nozzle associated with a capillary. The first end of the body having the nozzles may also be referred to herein as a face. The nozzles may be arranged in a substantially 2-dimensional array at the first end of the body. The capillaries may be arranged in a substantially parallel relationship within the body. The matrix material may be a silica based material (e.g., glass) or a polymeric material such as, for example, poly (methyl methacrylate) (PMMA), cyclic olefin copolymer (COC), or polycarbonate (PC).

In another embodiment, the capillaries may be formed together, as a set of capillaries within a single fibre, referred to herein as a microstructured fibre (MSF). In such an embodiment, the capillaries are substantially a plurality of pores (also referred to herein as holes) running through the length of the fibre. Although not essential, the capillaries may be substantially parallel with the longitudinal axis of the fibre. The fibre may be of a substantially uniform material (e.g., a matrix) such as, for example, a silica-based material like glass, or a polymeric material such as a plastic (for example, but not limited to, PMMA, COC, or PC), such that there is matrix material and no air space between capillaries.

Figure 12A:
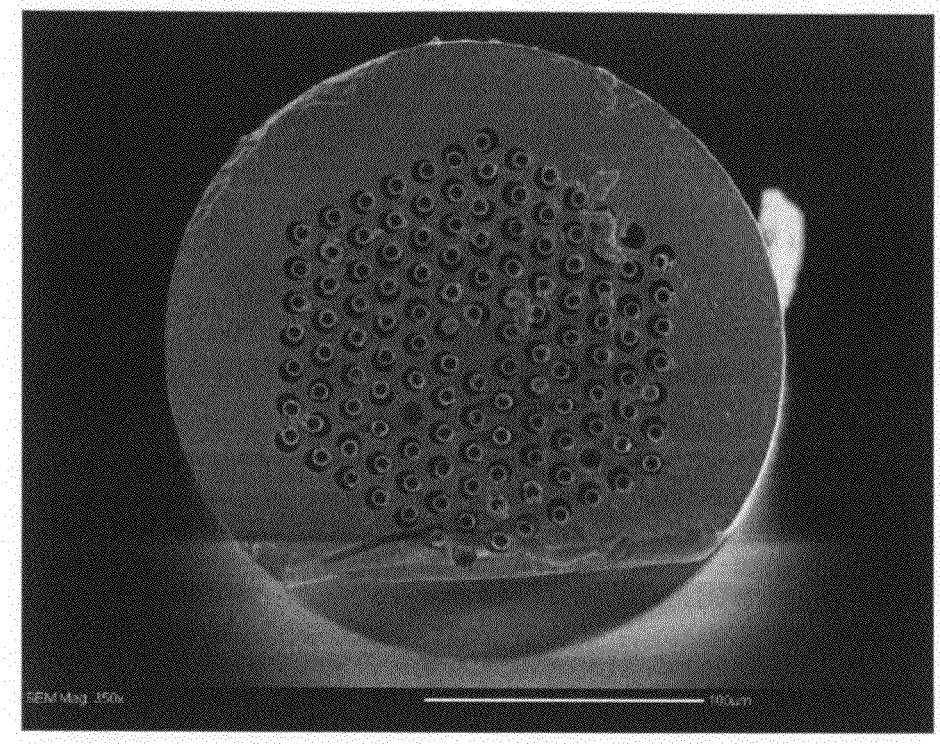
FIGS. 12*a* and 12*b* are SEM photomicrographs of a 168 channel MSF emitter prepared with polymer coating of the channels and etching.

The nozzles, the number of which corresponds to the number of channels, may be provided in a 2-dimensional array. That is, when an emitter is prepared by cutting a bundle of capillaries or by cutting a fibre including a plurality of capillaries, the cut end will become the face having a substantially 2-dimensional array of nozzles. For example, the array may comprise multiple rows (or columns) of nozzles. Such an arrangement may be used in embodiments having a large number of nozzles (see, e.g., FIGS. 12*a* and 12*b*). Alternatively, the array may comprise fewer nozzles in a spaced arrangement, such as radially spaced about a central axis of the fibre end or face (see, e.g., FIGS. 15*a* and 15*b*), or in some other arrangement. The array may be symmetrical or asymmetrical, with respect to, for example, the central axis of the fibre. Although not essential, the nozzles may be arranged such that they are equidistant from each other and/or equidistant from the central axis of the fibre. However, it is not essential that the nozzles are provided in a 2-dimensional array and a 3-dimensional array may be prepared by, for example, modifying (e.g., etching) the cut end of the fibre.

The number of channels, and hence the number of nozzles in the array, may range from 2 to 1,000, or from 2 to 200, or from 3 to 10,000, or from 3 to 1,000, or from 3 to 100, depending on the analyte, the desired flow rate, etc. The inside diameter of each capillary may be from 50 nm to 25 μm, or from 500 nm to 10 μm, or from 2 μm to 15 μm, or from 1 μm to 8 μm, for example, 4 μm to 5 μm, depending on the analyte, the desired flow rate, the number of channels, etc.

The flow rate that may be obtained with a MSF emitter as described herein will depend at least in part on the back pressure created by the emitter. The back pressure may depend on factors such as the number of capillaries, the diameter of the capillaries, and the length of the emitter. For example, a longer emitter will have greater back pressure than a shorter emitter. In some cases the length of an emitter may be determined by the application and/or equipment with which it is used. That is, for compatibility with an existing MS apparatus, for example, a length of 4 or 5 cm may be required. However, emitters of shorter lengths, such as 2.5 cm, or 2 cm, or shorter, may be prepared. By appropriately selecting parameters such as number of capillaries and emitter length, high flow rates (e.g., 50,000 nL/min, 5,000 nL/min) or low flow rates (e.g., 5 nL/min, 10 nL/min), as well as any flow rate between these high and low flow rates, may be achieved.

The multi-channel emitter may conveniently be made from a photonic crystal fibre (PCF), which is an example of a MSF. PCFs are commonly used for guiding light in optical applications. A PCF is essentially an optical fibre (usually made of silica and having an outer coating or cladding made of an acrylate-based polymer) having a plurality of microscopic air holes running along the entire length of the fibre. In optical applications PCFs have superior performance relative to conventional optical fibres, mainly because they permit low loss guidance of light in a core. PCFs have also been used in various non-optical applications (see Russell[26]), including microchip electrophoresis (Sun et al.[27]); however, none of those applications relates to multi-channel electrospray emitters.

Accordingly, one aspect of the invention relates to the use of a MSF, such as a PCF, for conducting an analyte. This aspect further relates to the use of a MSF, such as a PCF, as a multi-channel electrospray emitter. In one embodiment, the emitter may be a nanoelectrospray emitter. A multi-channel MSF emitter may be used for ESI mass spectroscopy, or in any application where micro- or nanospraying of a solution or analyte is required.

Another aspect of this invention relates to a multi-channel electrospray emitter based on a MSF, such as a photonic crystal fibre. In one embodiment the emitter may be a nanoelectrospray emitter. Such an emitter may be easily produced from a length of MSF, such as a length of PCF, and used in applications such as ESI MS. In ESI MS applications, little or no modification of the mass spectrometer is required. This is owing to the compact, 2-dimensional array of nozzles of an emitter produced from a MSF, which readily interfaces with the MS orifice.

As noted above, a plurality of individual capillaries may also be used to make a multi-channel electrospray emitter. In such an embodiment, the individual capillaries may be bundled together at one end to provide a 2-dimensional array of nozzles. At the other end, the capillaries must be connected to apparatus (e.g.; a pump) for delivering the analyte solution to the emitter. This may be accomplished by, for example, connecting each capillary to a manifold which is connected to the pump. However, such an arrangement may be difficult and time-consuming to set up for an emitter having many channels. Alternatively, the capillaries may be bundled together and connected to the pump as a single unit. However, a proper connection may be difficult to achieve because of the resulting spaces between channels (i.e., capillaries) in the bundle. Use of a MSF, such as a PCF, for a multi-channel nanoelectrospray emitter as described herein overcomes these difficulties because, as described above, the MSF lacks spaces between channels. That is, the only air spaces in the MSF nanoelectrospray emitter are the air holes of the channels themselves. Thus, a proper connection of the MSF emitter to the pump may be readily achieved via a single connection. Moreover, a MSF emitter may be prepared in substantially less time and at less cost than a multichannel emitter prepared from a plurality of individual capillaries. It should be noted that in some embodiments wherein electrokinetic flow is possible, a pump may not be required.

To perform effectively in a wide spectrum of mass spectrometry applications, a MSF emitter should be able to electrospray highly aqueous samples. For example, when running reversed phase liquid chromatography (LC) gradients most separations require beginning the gradient at high aqueous followed by gradual increment of the organic phase. An emitter that is coupled to the LC therefore must be able to perform efficiently at the two solvent extremes. In addition, in structural proteomics, some proteins/cells are denatured by the addition of organic solvents, necessitating working in aqueous environments. Further, some noncovalent complexes are severely altered by organic modifiers. All these areas require an emitter that can perform well in highly aqueous environments. However, it is difficult to electrospray aqueous samples using commercially-available silica based emitters because of the high surface energy of the hydrophilic silica surface and its interaction with water. The hydrophilic interactions between the water droplets and the surface silanol groups result in a wetting effect and thus poor electrospray.

The inventors have found that modification of the MSF emitter may enhance performance. For example, it has been found that a PCF emitter may be functionalized with one or more chemical moieties to overcome negative aspects such as hydrophilic interactions with the analyte, thus improving stability and sensitivity. Functionalizing the emitter may include subjecting the emitter to covalent modification. In particular, a portion on the emitter associated with the nozzles may be functionalized with one or more chemical moiety. In one embodiment, the nozzles may be functionalized with one or more hydrophobic moiety to enhance performance using aqueous analytes. Such hydrophobic derivatization of the emitter includes altering the surface wetting characteristics of the silica such that the water contact angle is increased relative to that of bare fused silica. Examples of chemical moieties that may be used for this purpose include metals, hydrophobic proteins/peptides, and other hydrophobic moieties, such as, but not limited to, perfluorooctylchlorosilane, octadecylsilane, chlorotrimethylsilane (CTMS), and silylation reagents, such as γ-methacryloxypropyltrimethoxysilane (γ-MAPS). Without wishing to be bound by theory, it is believed that the hydrophobicity of the nozzles prevents aqueous samples from wetting the surface, resulting in a better electrospray. Contact angle experiments conducted in our laboratory have shown that the water contact angle may be increased from about 50° to about 127° for CTMS derivatized fused silica.

When using organic analytes, performance of unmodified emitters prepared from silicate materials, including PCF emitters, is generally very good because of the hydrophilic property of the silicate material. However, if required and/or desired, modification of emitters with one or more hydrophilic moiety may be carried out. Such hydrophilic derivatization of the emitter includes altering surface wetting characteristics such that the water contact angle is decreased relative to that of bare fused silica. An example of a suitable derivatization agent is acrylamido-2-methyl-1-propane sulfonic acid.

A PCF emitter may be further modified by removing the cladding and etching the silicate material on the outside of the fibre at the nozzle end of the emitter. The silicate material may be etched to reduce the thickness of the outside walls of the outer channels of the array, which is believed to improve emitter performance. Such etching may be achieved, for example, by flowing water through the channels of the PCF (e.g., 0.2 to 2 microliters/minute) and immersing the tip to be etched in an etching solution (e.g., 50% hydrofluoric acid/50% water for two minutes).

A MSF emitter such as a PCF emitter may be modified by applying a conductive coating such as a metal coating to the entire emitter, to the nozzles, or any portion thereof. A conductive coating facilitates the application of a voltage to the emitter, typically by a clip or wire optionally with the assistance of conductive paint or adhesive. The conductive material may be applied using any suitable technique. For example, a metal such as, but not limited to, gold, platinum, and palladium, and combinations thereof, may be vacuum deposited onto the emitter. Such an emitter may have a short lifetime (e.g., 15 minutes to 3 hours), since the thin deposited layer is susceptible to deterioration to an extent capable of altering the required voltage or positioning for stable electrospray. The robustness of a metal-coated emitter may be improved by overcoating the metal layer with a layer of an insulating material such as, for example, $SiO/SiO_2$. The overcoating may be carried out by, for example, thermal evaporation and deposition, or any other suitable technique. The insulating layer may be, for example, 10-50 nm thick. Such an insulating layer may improve emitter lifetime by 1-2 hours.

In other embodiments, the conductive coating may include an adhesion layer undercoating. The adhesion layer may include a ligand appropriate for a component (e.g., a metal) in the conductive coating. The ligand may include a thiol moiety. For example, (3-mercaptopropyl)trimethoxysilane, a bifunctional reagent, may be condensed onto the silica surface of the emitter leaving a thiol moiety exposed, to better adhere to the gold (or other metal), taking advantage of its natural affinity for the ligand (Kriger et al. 1995). As another example, a chromium layer may be first deposited onto the emitter surface using, for example, an electron beam, to provide a metallized layer that better adheres to the silica prior to the vacuum deposition of the metal layer (Barnidge et al. 1999). A vacuum-deposited metal layer may be used as an undercoating where a second thicker metal layer is subsequently applied by electroplating.

Figure 11A:
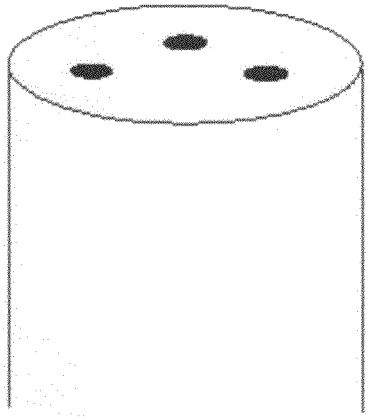
FIGS. 11*a* and 11*b* are diagrams comparing nozzle configuration on an MSF emitter prepared without polymer coating of the channels and etching (FIG. 11*a*), and of an MSF emitter prepared with polymer coating of the channels and etching (FIG. 11*b*).
Figure 11B:
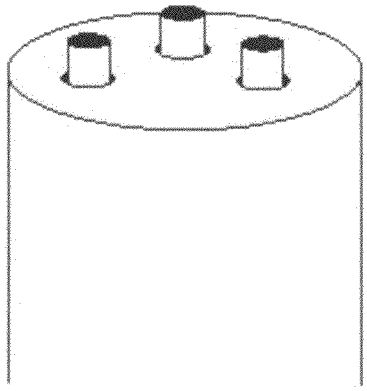

Further modification of the MSF to improve emitter performance includes modifications that elevate the nozzles above the surrounding matrix material of the emitter face, as shown schematically in FIG. 11*b* (compare with FIG. 11*a*, which shows an MSF emitter without such modification). Such modification enhances the ability of a multi-channel electrospray emitter to produce multiple electrosprays (e.g., a distinct Taylor cone produced by each nozzle). In MSF emitters prepared with a flat tip face, the spray from individual nozzles may coalesce, preventing multiple electrosprays. Modification such as that shown in FIG. 11*b* avoids coalescence of the individual sprays.

This modification may be achieved various ways, such as, for example, a focused ion beam (FIB) can be used to "grow" walls around each nozzle so as to effectively raise them above the face of the MSF. However, this technique is very expensive, very slow, and there are limitations as to the maximum length of MSF that can be accommodated in the machine (e.g., 7 cm). Photolithographic dry etching may be used if repeated many times in succession; however, the task of accurately positioning a photo mask for each layer of etching is extremely difficult. Wet etching may also be used, and is an inexpensive, simple approach. For etching silicate materials from which MSFs are typically made, the etchant may include, for example, a fluoride ($F^-$), such as, but not limited to HF (aq), NaF (aq), KF (aq), and $NH_4F$ (aq). For example, aqueous ammonium bifluoride, which exists as the bifluoride ion ($HF_2^-$), but can also use other cations (e.g., potassium), may be used. Etching power will of course vary depending on the form of the etchant, but should only change etch time.

For wet etching of the matrix material of the emitter face, a layer or coating may be formed on the inside walls of each channel prior to etching. The layer is formed from a material that resists or is not affected by the etching process (i.e., substantially does not react with the etchant). A polymer is one class of material that is well suited as such a coating. For example, the polymer may be a divinylbenzene (DVB) material such as, but not limited to, polystyrene-divinyl benzene, a DVB homopolymer, DVB-vinylpyridine, DVB-ethylene glycol dimethacrylate (EDMA), DVB-acrylonitrile. Other examples of suitable polymers include, but are not limited to methyl, butyl, or stearyl methacrylate-EDMA, polyacrylamide-bisacrylamide, cyclodextrin, polyurethane, epoxy, polyvinyl alcohol (PVA), polyvinyl pyrrolidone (PVP), and various charged polymers, such as, for example, polyethyleneimine (PEI). It will be appreciated that many other polymer classes are potentially useful for coating the channel walls. Selection of a suitable polymer may depend on the specific application. For example, polymers inherently provide a wide range of hydrophobicities and accordingly a polymer may be selected on the basis of the hydrophobicity required for a given application. When the polymer-coated MSF is etched, the polymer is unaffected by the etchant, such that polymer tubes remain protruding from the face of the MSF after etching. This allows for a greater separation of Taylor cone sprays.

A coating such as a polymer may obviate the need for treating with a hydrophobic agent as described above. However, coated and etched MSF emitters as described herein may be treated with any of the hydrophilic or hydrophobic materials described above, as required for a specific analyte. The polymer nozzles raised above the emitter face may be functionalized by, for example, selecting a polymer having a desired functionality for preparing the nozzles, grafting a further polymer onto the polymer of the nozzles, the further polymer having a desired functionality, or chemically modifying the polymer of the nozzles.

To demonstrate a multi-channel nanoelectrospray emitter using a MSF, two groups of PCFs were employed. In the first group two PCFs were used, one having 30 channels and the other having 168 channels. In the second group, PCFs having 30, 54, 84, and 168 channels were used. Performance of emitters made from these PCFs was compared to that of commercially-available single channel emitters. Emitters produced from the PCFs exhibited remarkably high stability of the electrospray at flow rates from 20 nL/min to 500 nL/min, or 20 nL/min to 1000 nL/min, or 20 nL/min to 10,000 nL/min. Further, the PCF emitters were highly resistant to clogging, and when used for mass spectrometry, they provided enhanced sensitivity relative to the commercially-available single channel emitter. An emitter was also prepared from a 168 channel MSF by polymer coating the channels and etching. Details are provided in the following non-limiting Working Examples.

All cited publications are incorporated herein by reference in their entirety.

WORKING EXAMPLES

Example 1

Sample Preparation and Reagents

Methanol, toluene, glacial acetic acid and acetonitrile (HPLC grade) were purchased from Fisher Scientific (Ottawa, ON Canada) and used without further purification. Formic acid (analytical reagent, 98%) was purchased from BDH Chemicals, (Toronto, ON Canada). Leucine enkephalin (synthetic acetate salt), [3-(methacryloyloxy)propyl]trimethoxysilane (γ-MAPS) and chlorotrimethylsilane (98%) (CTMS) were from Aldrich (Oakville, ON Canada). Deionized water was obtained from a Milli-Q system (Millipore, Bedford, Mass., USA) and was 18 MΩcm or better in resistance.

Two groups of PCFs were used. For the first group, F-SM16 and F-SM20, obtained from Newport Corporation (Irvine, Calif., USA), were used. The F-SM16 PCF had 30 channels, and each channel had an internal diameter of 4 to 5 μm. The F-SM20 PCF had 168 channels, and each channel had an internal diameter of 4 to 5 μm. For the second group, PCFs having 30, 54, 84, and 168 channels were purchased from Crystal Fibre (NKT Photonics A/S, Denmark). These MSFs had internal channel diameters estimated to be about 5, 4.2, 5, and 5 microns, respectively, and measured to be 4.9, 3.8, 4.3, and 5.6 microns, respectively. Pulled-tip single channel emitters (non-coated internal tip diameters of 5, 15, and 30 μm, PicoTip SilicaTip) were obtained from New Objective (Woburn, Mass., USA).

Functional Modification of Photonic Crystal Fibres (PCF)

Figure 1:
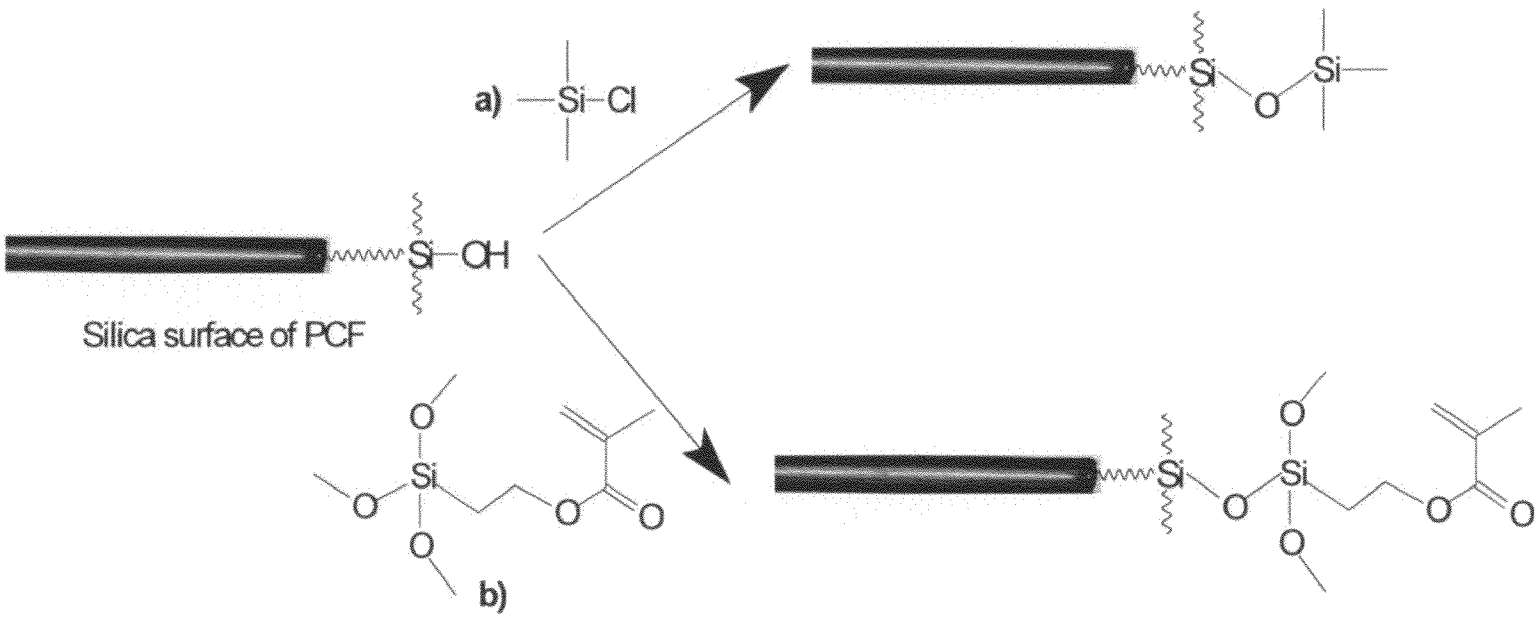
FIG. 1 is a schematic diagram showing derivatization reactions of the silanol groups on a photonic crystal fibre (PCF) with silylation reagents a) chlorotrimethylsilane (CTMS), and b) γ-methacryloxypropyltrimethoxysilane (γ-MAPS).

From our previous work we have found that minimization of edge effects improves emitter performance, and to this end a fibre cleaver (FiTel, Furukawa Electric, Japan) was used to cut PCF material into 4 or 5 cm segments, to ensure a uniform cut. The end of each segment to be modified was immersed in a silylation reagent solution (20% (v/v) of either γ-MAPS or CTMS in toluene). A schematic diagram illustrating the reaction is shown in FIG. 1. After overnight reaction at room temperature, the PCF segments were rinsed with acetonitrile/water solution (80/20) before further use, using a syringe pump set at 500 nL/min. The tapered emitters were rinsed with the same solvent mixture but using a NanoLC-1D pump from Eksigent (Dublin, Calif., USA) directly prior to spraying to reduce the chances of clogging.

Instrumentation and Evaluation of Emitter Performance

Figure 2:
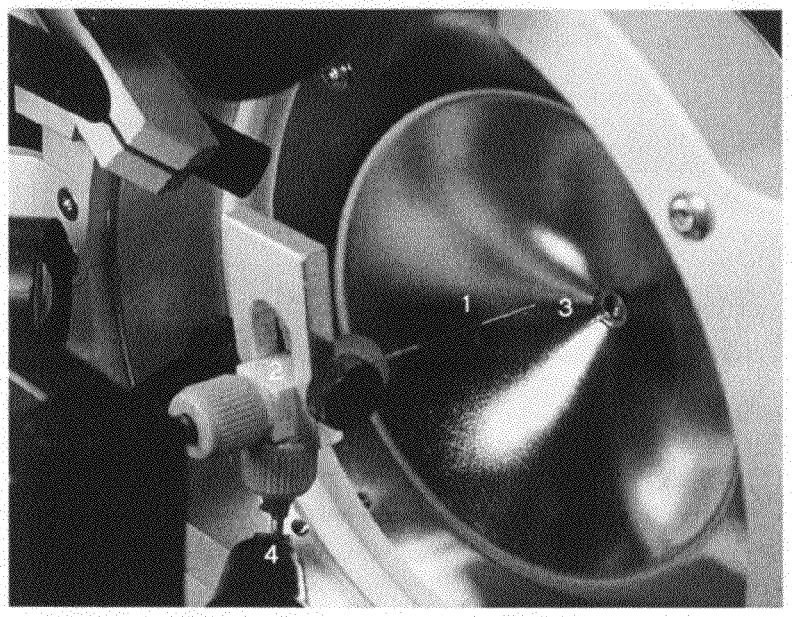
FIG. 2 is a photograph showing the experimental setup of a PCF nanoelectrospray emitter interfaced by liquid junction to the MS orifice.

The experimental setup for evaluating performance of multi-channel PCF emitters and single channel commercially available emitters is shown in FIG. 2. Mass spectra were obtained using an API 3000 triple-quadrupole mass spectrometer (MDS Sciex/Applied Biosystems, Streetsville, ON, Canada) fitted with a nanospray interface (Proxeon, Odense, Denmark). Referring to FIG. 2, an emitter 1 was held in place by a MicroTee 2 (Upchurch, SPE Ltd., North York, ON, Canada), which was mounted on an x-y-z stage. The stage and two CCD cameras were used for final positioning of the emitter end at distances to the MS orifice of 2 to 20 mm (indicated by numeral 3 in FIG. 2). Delivery of samples to the emitters was accomplished by direct infusion from a 30 μL silica capillary custom loop connected to a 6-port ChemInert valve (VICI Valco, Brockville, ON, Canada) and a NanoLC-1D pump (Eksigent, Dublin, Calif., USA). A liquid junction platinum electrode 4 was used to supply the electrospray voltage (see FIG. 2).

Each emitter's performance was evaluated by, for example, assessing the stability of extracted ion current (XIC) traces, the mass spectrum peak intensity (m/z), and the mass spectrum peak height generated per mole of analyte using a leucine enkephalin solution (1 μM). Solvent compositions ranged from highly organic solutions (90% methanol) to highly aqueous solutions (99.9% $H_2O$ and 0.1% formic acid). For the first group of MSF emitters, performance was evaluated using a 1 μM leucine enkephalin solution with a solvent composition of 50% $H_2O$/acetonitrile (0.1% formic acid). To evaluate electrospray of highly aqueous samples using chemically modified PCF emitters, leucine enkephalin solutions of 90% and 100% water (0.1% formic acid) were employed. The stability, reproducibility and sensitivity of the nanoelectrospray from each emitter was evaluated.

Electrosprays were generated off-line (i.e., without a mass spectrometer) using the experimental set up shown in FIG.

3*a*. A 0.5 mL Hamilton syringe (Gastight #1750) 10 was set in a 11Plus pump 12 (Harvard Apparatus, Holliston, Mass., USA) to deliver high aqueous samples (99.9% water. 0.1% formic acid) through the PCF emitter 14 via an Upchurch MicroTee 16 with a liquid junction electrode 18. The voltage source 20 was a Trisep™ 2100 high voltage module (Unimicro Technologies Inc., Pleasanton, Calif., USA). A grounded metal plate 22 was placed about 5 mm away from the emitter 14. Electrosprays were photographed using a Nikon Eclipse TE 2000-U microscope 24 equipped with a direct visualization system 26 (Q-Imaging, QICAM with Simple PCI software (Compix Inc. Imaging Systems, 705 Thomson Park Drive, PA, USA)).

Hanks solution was used to evaluate resistance of the emitters of group 2 to clogging. The Hanks solution was prepared by adding 0.8 g sodium chloride, 0.02 g calcium chloride, 0.02 g magnesium sulfate, 0.04 g potassium chloride, 0.01 g monobasic potassium phosphate, 0.127 g sodium bicarbonate, 0.01 g dibasic sodium phosphate, and 0.2 g glucose to sufficient Milli-Q water for a 100 mL final volume. Referring to FIG. 3*b*, the emitter 14 was connected first to a 63 cm long, 50 μm i.d. fused silica capillary filled with a 5 μM leucine enkephalin (LE) solution, for establishing an initial stable TIC trace. This capillary was then connected through a micro-union to a 50 cm long, 150 μm i.d. capillary filled with Hanks solution, which was then connected to a nano-pump 30 through a six-port valve 32 and sample loop 34. The solutions were sequentially infused through the emitters at 300 nL/min to the MS 36. The backpressure and "time to clog" was used to ascertain the relative robustness of each emitter.

To evaluate MSF emitter longevity, emitters of group 2 were allowed to continuously spray at 250 nL/min a solution of verapamil (0.6 μM) and leucine enkephalin (0.7 μM) in 50% MeOH with 0.1% acetic acid for over 5 hours. Maintenance of analyte signal levels and stable electrospray trace for the TIC were taken as measures of emitter longevity.

Results and Discussion

Figure 4A:
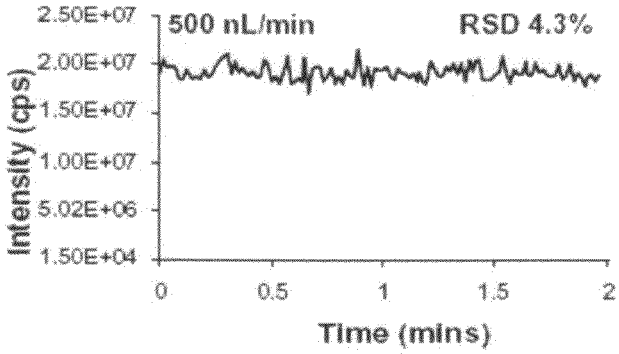
FIG. 4 shows MS data obtained using an unmodified 30 channel PCF emitter, total ion current (TIC) was obtained by infusing 1 μM leucine enkephalin (1:1, v/v, water/acetonitrile) at flow rates of (a) 500 nL/min, (b) 300 nL/min, and (c) 50 nL/min. Mass spectrum (d) was obtained by averaging the TIC obtained at 50 nL/min with the 1 μM leucine enkephalin solution. The bar graph (e) shows the increase in sensitivity with decreasing flow rate. Mass spectrum (f) was obtained by averaging the TIC obtained at 300 nL/min with a 0.2 μM leucine enkephalin solution.
Figure 4B:
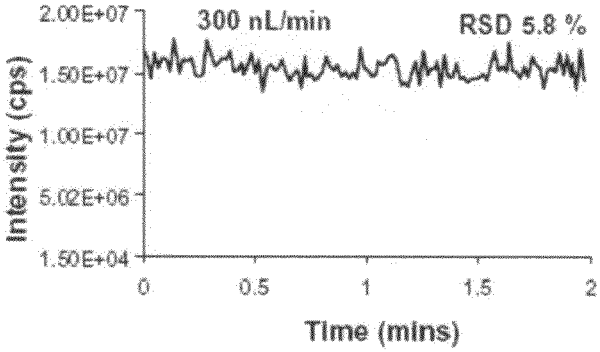
Figure 4C:
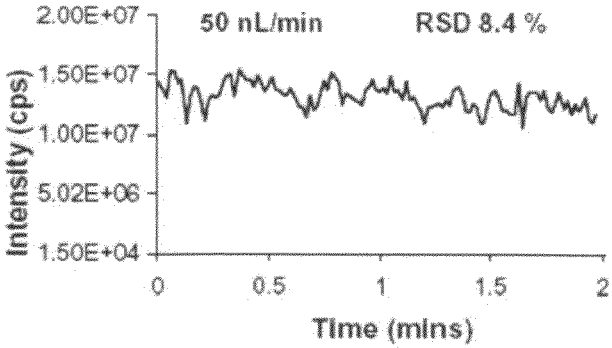
Figure 4D:
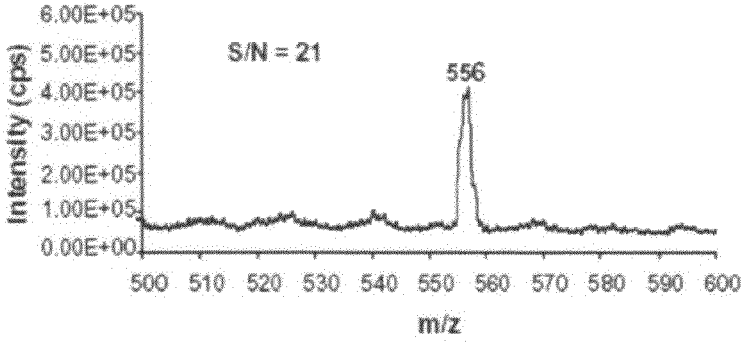
Figure 4E:
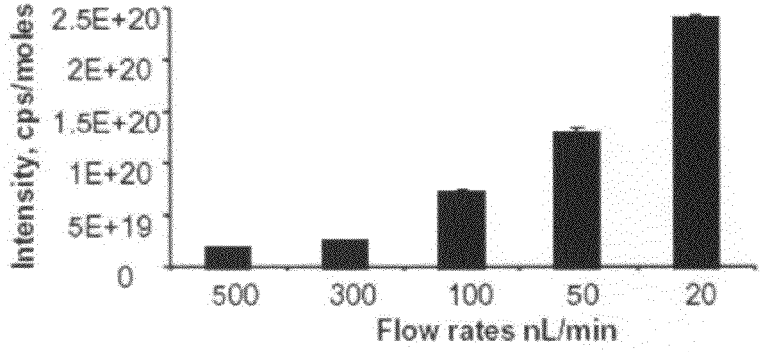

Performance of both unmodified PCF emitters and PCF emitters modified using a silylation reaction was evaluated at flow rates ranging from 500 to 20 nL/min by direct infusion of various concentrations of leucine enkephalin solutions. For the unmodified PCF emitters, the analyte (1.0 μM leucine enkephalin solution) was dissolved in (1:1, v/v) water/acetonitrile (0.1% formic acid). FIG. 4 shows performance of the unmodified 30 channel PCF emitter from group 1. The total ion current (TIC) traces shown in FIGS. 4*a*, 4*b*, and 4*c* show that these emitters provided stable electrospray, relative standard deviation (RSD)<10% at flow rates from 500 to 50 nL/min. At 20 nL/min, the RSD was about 15%, which is not surprising since the integrity of the nanopump becomes a factor at such low flow rates. FIG. 4*d* shows the signal to noise ratio (S/N) for the leucine enkephalin peak, m/z, 556, at 50 nL/min flow rate. It is clear that even at such a low flow rate the signal to noise ratio is reasonably high, indicating that minimization of matrix effects is among the advantages of running samples at nano flow rates. In view of these results it is expected that PCF emitters can be used at ultra low flow rates, for example, at least as low as 20 nL/min, making them valuable tools in MS work. FIG. 4*e* shows the change in intensity per mole of analyte at different flow rates, illustrating the improvement in sensitivity at such low flow rates.

Figure 4F:
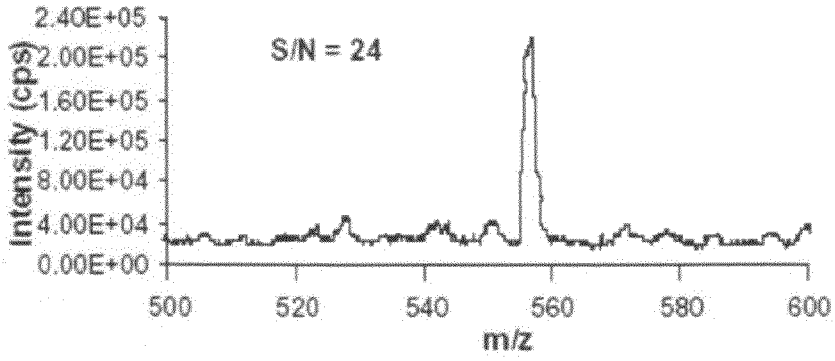

The unmodified 30 channel PCF emitter from group 1 was subjected to a brief sensitivity study employing concentrations of leucine enkephalin from 2.0 μM to 0.02 μM in 50% aqueous methanol solution. FIG. 4*f* shows the mass spectrum from a two-minute time-averaged TIC for the 0.2 μM concentration of leucine enkephalin where, at 300 nL/min, a S/N=24 was obtained. In all cases there were no peaks observed that could be attributed to impurities within the emitter itself. A limit of detection was approached with the 0.02 μM sample at a flow rate of 20 nL/min where the S/N dropped to about 6. This corresponds to about 0.8 femtomoles of analyte and clearly demonstrates the utility of the multi-channel emitter for detection of low abundance species.

As noted above, electrospraying of aqueous analytes may be hindered by hydrophilic interactions between water droplets and the surface silanol groups of the PCF. Studies conducted herein demonstrate that such interactions can be attenuated or eliminated by silanizing the PCF emitter with hydrophobic γ-MAPS or CTMS, as described above and shown schematically in FIG. 1.

Figure 5A:
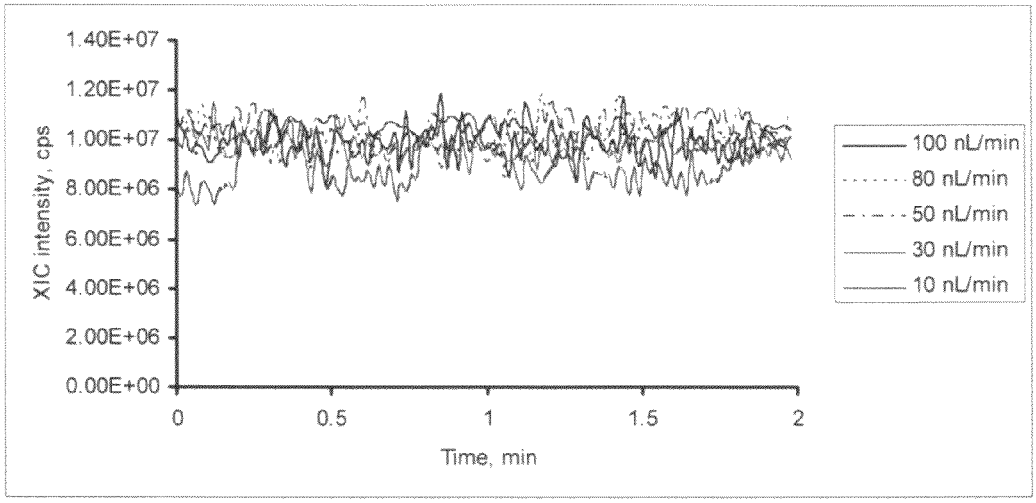
FIG. 5 shows MS data obtained using a γ-MAPS-modified 30 channel PCF emitter and infusion of 1 μM leucine enkephalin in 9:1 (v:v) water/acetonitrile: (a) extracted ion chromatograms at different flow rates; (b) intensity as function of flow rate; (c) mass spectrum showing the signal to noise ratio at different flow rates; and (d) a graphical representation of the sensitivity of the emitter, showing counts per mole of analyte at various flow rates.
Figure 5B:
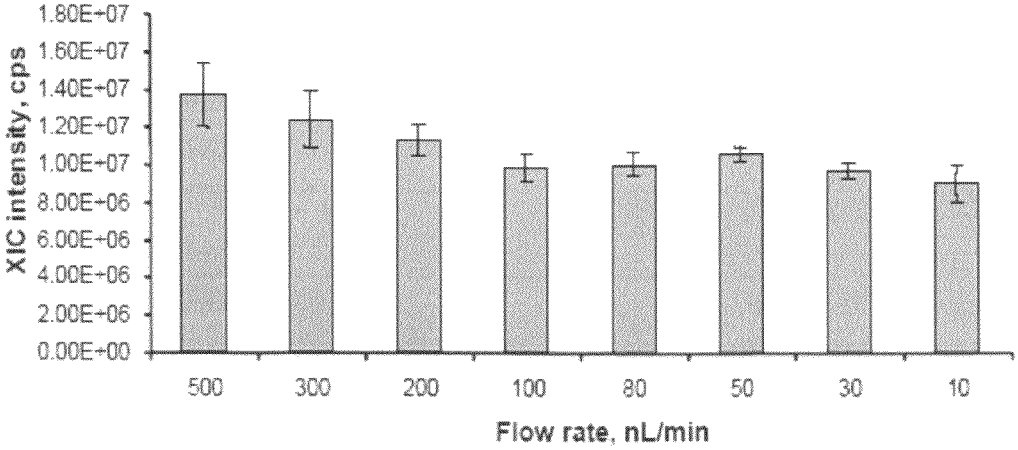
Figure 5C:
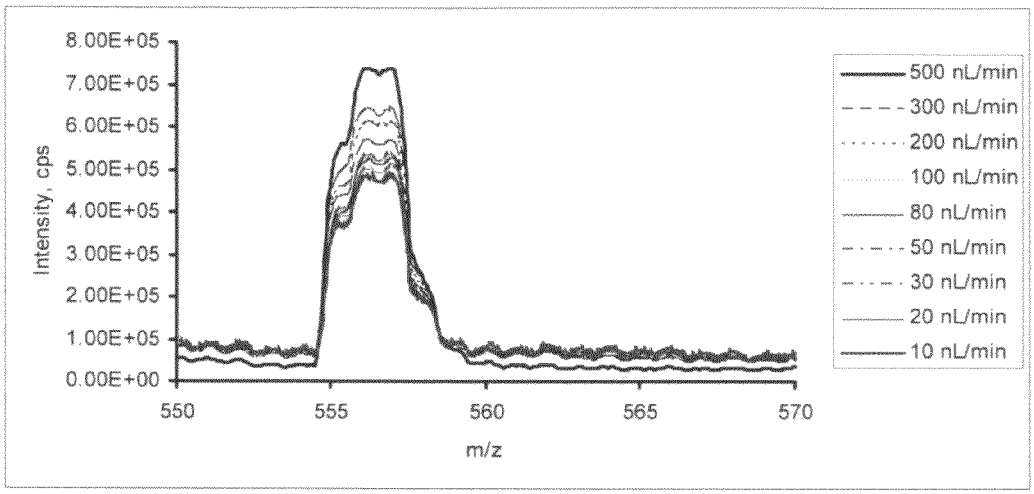
Figure 5D:
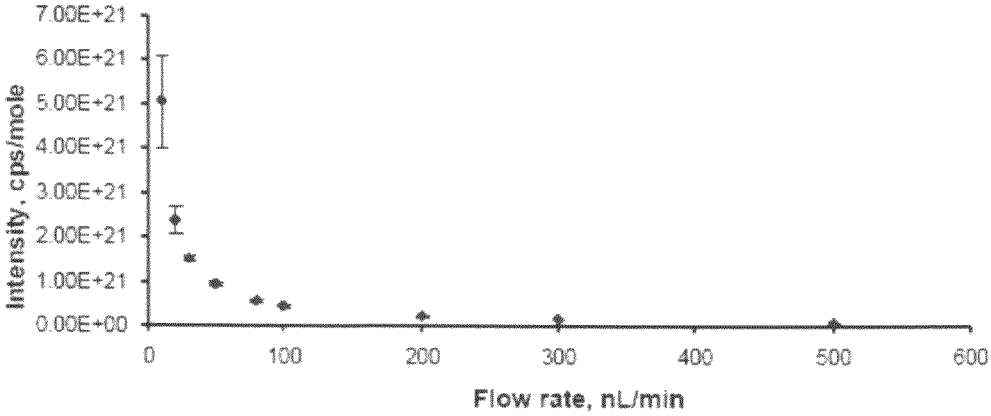

A γ-MAPS-modified 30 channel PCF emitter from group 1 was tested by electrospraying 1.0-μm leucine enkephalin in 9:1 (v:v), water:acetonitrile (0.1% formic acid). FIG. 5*a* shows the stability of the resulting electrospray at different flow rates, including an ultra low flow rate of 10 nL/min. Such a low flow rate may be the lower limit for the Eskigent nanopump employed in the experimental setup. As expected, therefore, the RSD of the resulting TIC is high compared to higher flow rates, where the pump's integrity is uncompromised. However, as the flow rate was reduced to 10 nL/min, there was only a marginal decrease in the intensity of the analyte peak, m/z, 556, (FIG. 5*b*) and the signal to noise ratio (FIG. 5*c*). As expected, there is an exponential increase in sensitivity associated with decreasing flow rate as shown in FIG. 5*d*.

Figure 6A:
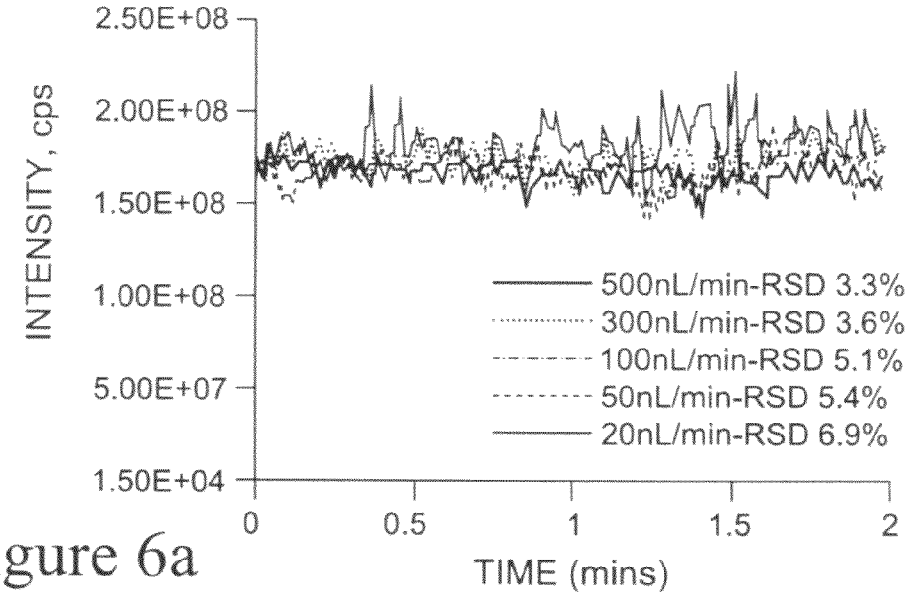
FIG. 6 shows results obtained from nanoelectrospray of 1 μM of leucine enkephalin (in 99.9% water, 0.1% HCOOH) using a CTMS-modified 30 channel PCF emitter and a commercially-available single channel silica tapered emitter at 500-20 nL/min flow rates: a) TIC traces of CTMS modified PCF emitter; b) TIC traces of tapered emitter (the lowest trace corresponds to 20 nL/min and the second lowest trace corresponds to 50 nL/min; the traces for the 100, 300, and 500 nL/min flow rates are similar); c) comparison of sensitivity of the CTMS-modified PCF emitter and the tapered emitter.
Figure 6B:
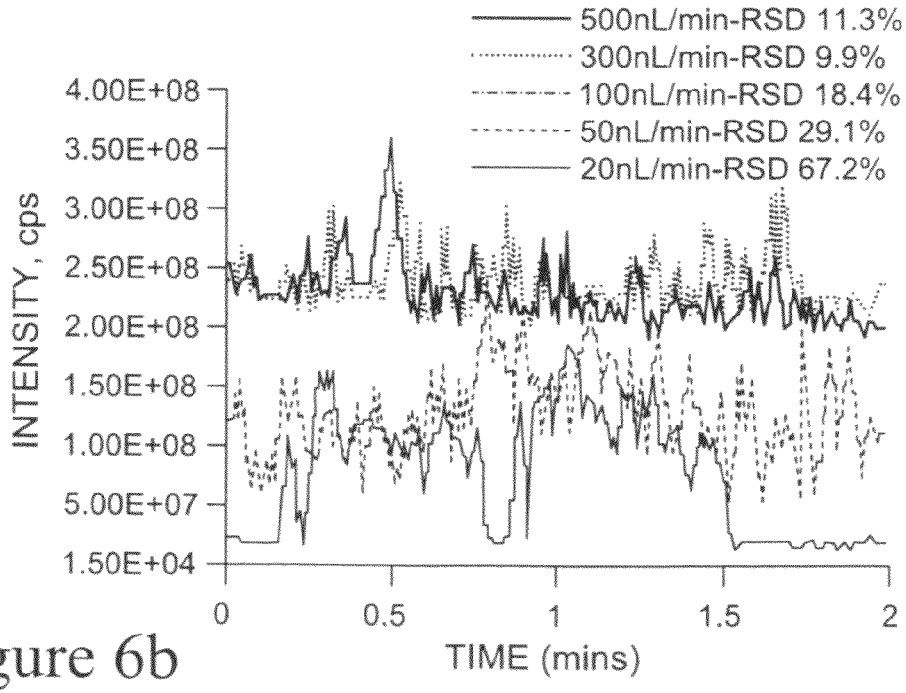
Figure 6C:
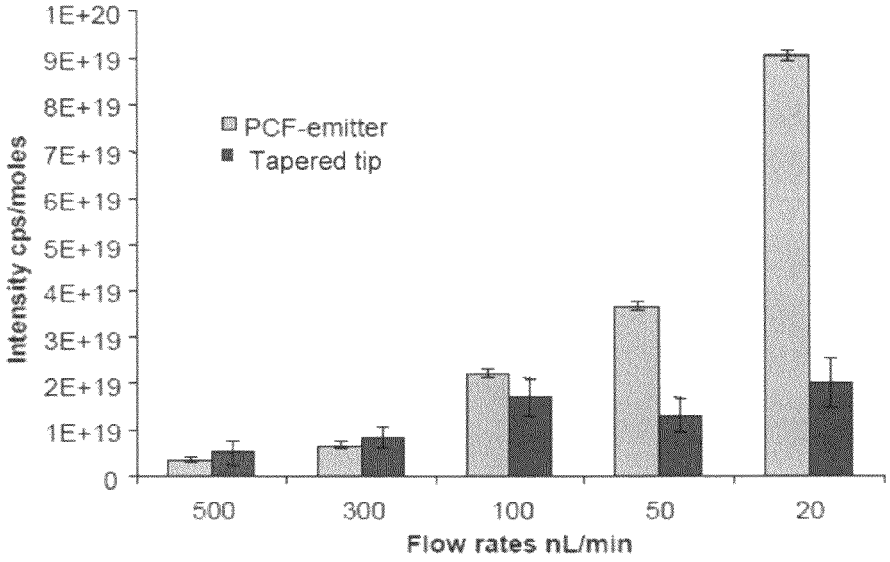

To electrospray samples up to 100% aqueous, a 30 channel PCF emitter from group 1 was modified with CTMS and infused with a leucine enkephalin solution in 100% water (0.1% formic acid). The PCF emitter was compared to a New Objective tapered silica capillary emitter with an aperture diameter of 5 μm, which is close to the diameter of each channel of the a PCF emitter. FIG. 6 summarizes the results obtained for the CTMS modified PCF emitter and the New Objective emitter. Performance of the modified PCF emitter was stable for 500 to 20 nL/min flow rates, with RSD ranging from 3.3 to 6.9%, as shown in the TIC traces in FIG. 6*a*. Electrospray of the New Objective emitter was not stable over the same range of flow rates, as shown in TIC traces of FIG. 6*b*, where the RSD ranged from 11.3 to 67.2%. The instability of the New Objective emitter was also observed, where droplets grew at the emitter tip and then sputtered. FIG. 6*c* is a bar graph showing a comparison of the sensitivity of the CTMS modified PCF emitter and the single aperture New Objective emitter at different flow rates. At higher flow rates, the modified PCF emitter was only slightly more sensitive than the tapered emitter, but at low flow rates the increase in sensitivity for the PCF emitter is dramatic. Indeed, at 20 nL/min, the modified PCF emitter exhibited about 4.5 times greater sensitivity than the single emitter. Without wishing to be bound by theory, it is believed that the increase in sensitivity is attributable to the formation of multiple Taylor cones at low flow rates, while at higher flow rates fewer Taylor cones are formed due to interaction of the spray from the individual nozzles of the PCF emitter.

As noted above, electrospraying highly aqueous samples is important for applications such as reverse-phase LC gradients, as well as in structural proteomics, where samples may not tolerate significant organic solvent content without denaturation. These results confirm that with the surface treatment, the PCF emitters can spray highly aqueous solutions as well as organic solutions.

All PCF emitters of group 2 showed negligible backpressures at low nano-flow rates, and only moderate backpressures at 1000 nL/min (see Table 1). The capability of allowing for electrospray at a large range of flow rates will be beneficial to LC-ESI-MS operations.

TABLE 1

Backpressures (psi) at different flow rates from multi-channel PCF emitters of group 2

| Emitters | 50 nL/min | 500 nL/min | 1000 nL/min |
|---|---|---|---|
| 30 channels | 6.9 ± 0.2 | 117.2 ± 0.7 | 256.2 ± 0.8 |
| 54 channels | 14.6 ± 0.9 | 197.6 ± 1.1 | 382.6 ± 1.9 |
| 84 channels | 11.2 ± 0.8 | 151.0 ± 0.7 | 300.8 ± 0.8 |
| 168 channels | 9.4 ± 0.5 | 123.4 ± 0.5 | 245.0 ± 0.7 |

In Table 1, data for the 30 channel emitter may not be reliable due to leakage subsequently discovered in the experimental setup for that emitter.

Figure 9A:
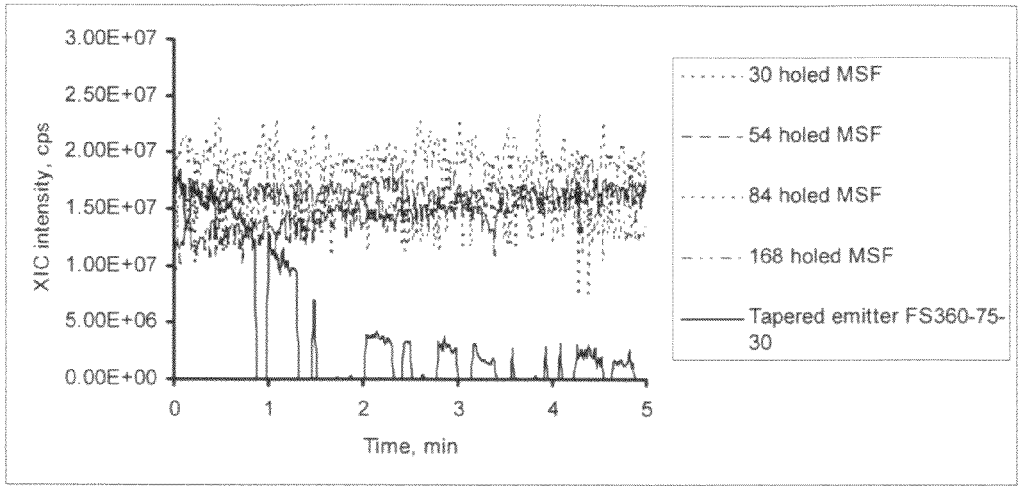
FIGS. 9*a*, 9*c*, and 9*e* show ion current (XIC) traces of 30, 54, 84, and 168 channel MSF emitters and a tapered emitter (FS360-75-15), obtained by infusing 1 μM LE in 1:1 methanol/water solution at 1000, 500, and 50 nL/min respectively.
Figure 9B:
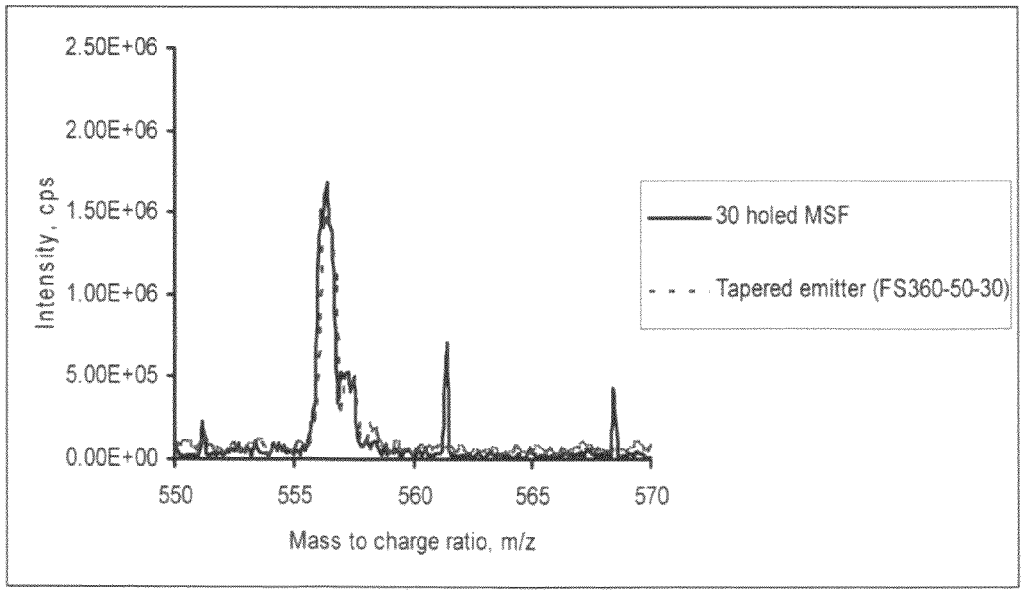
FIGS. 9*b*, 9*d*, and 9*f* show representative peak intensity comparisons of a 30 channel MSF emitter and a tapered emitter (FS360-50-30) under the same conditions as FIGS. 9*a*, 9*c*, and 9*e*.
Figure 9C:
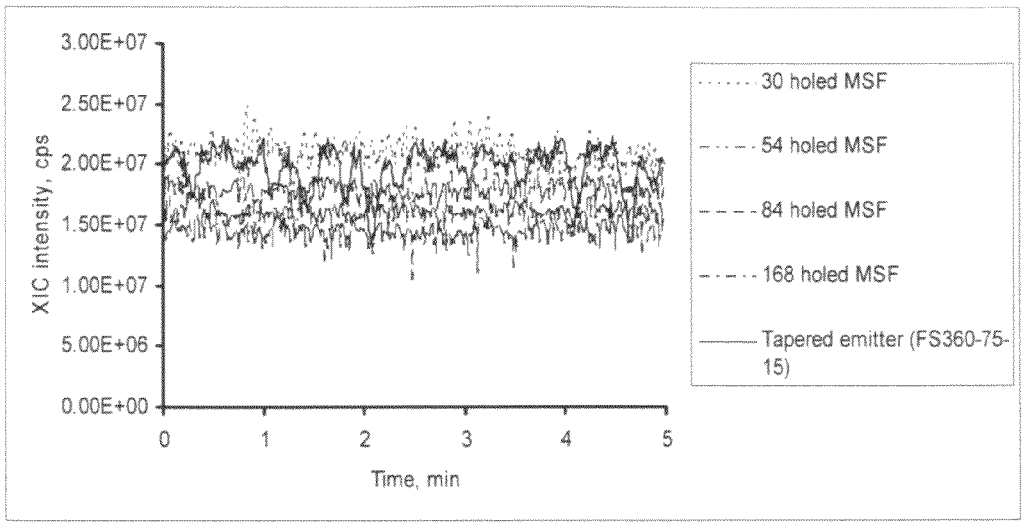
Figure 9D:
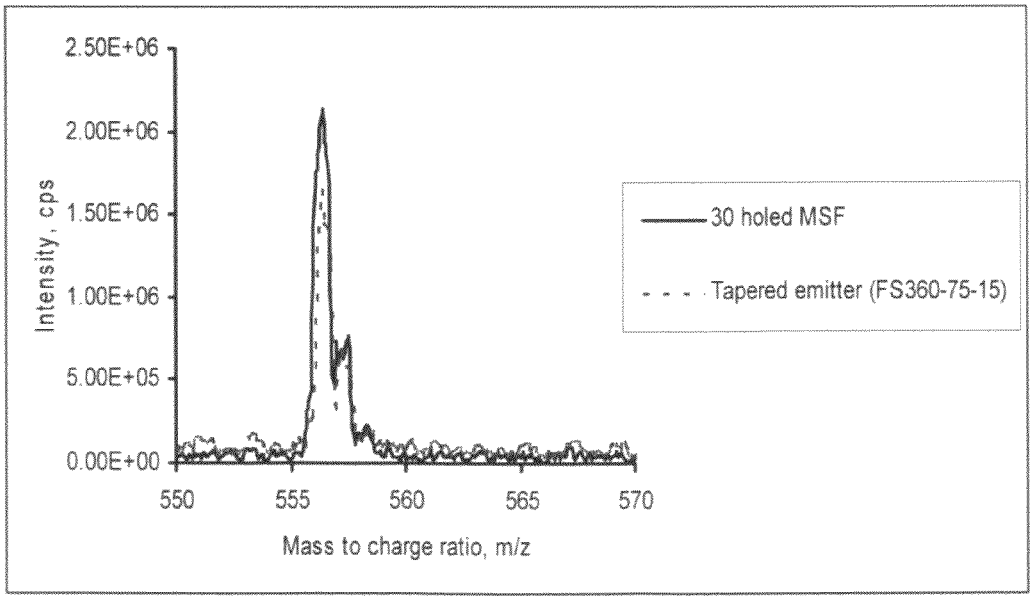
Figure 9E:
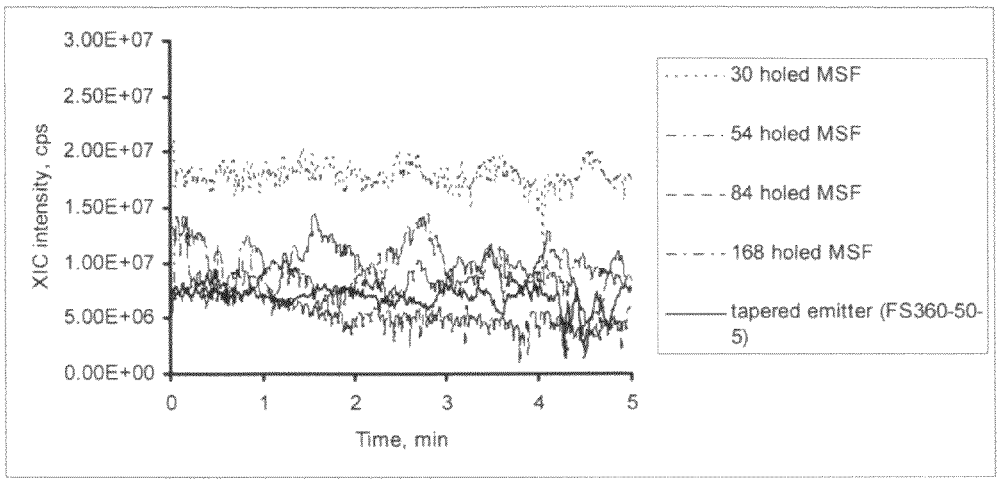
Figure 9F:
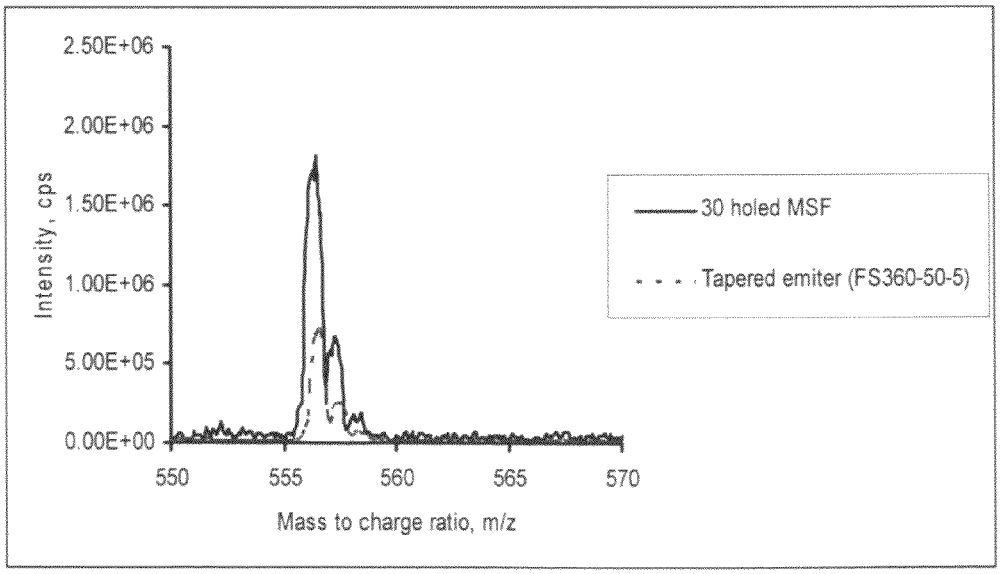
Figure 9G:
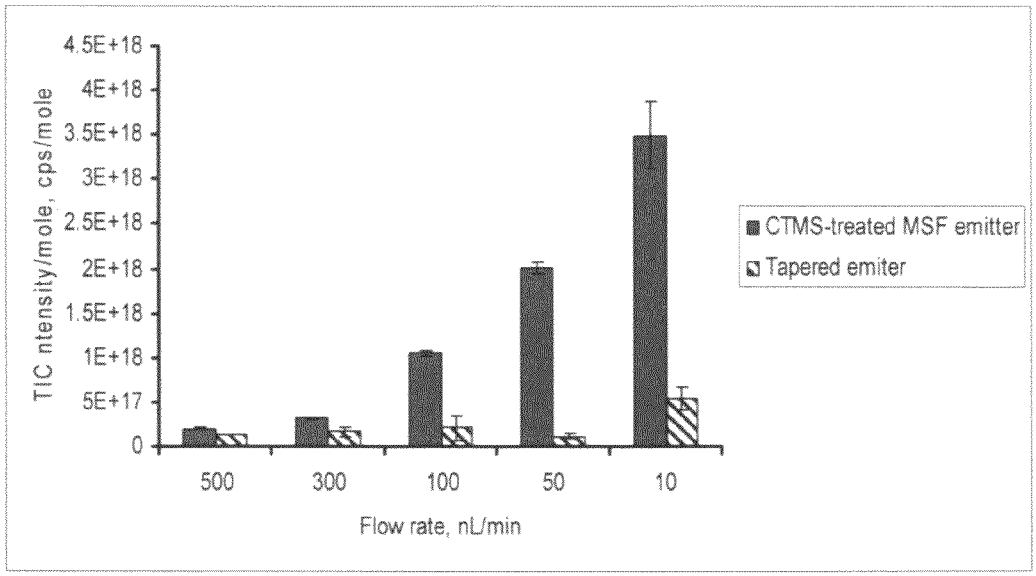
FIG. 9*g* shows a comparison of electrospray stability and sensitivity of a CTMS-treated 30 channel MSF emitter and a tapered emitter (FS360-50-30) obtained by spraying a 90% aqueous solution as a function of flow rate.

FIGS. 9*a-f* show electrospray performance of PCF emitters of group 2 at various conditions in comparison with tapered emitters. Use of tapered emitters followed the manufacturer's protocols for their use with nano-ESI interface. Tapered emitters with different tip sizes were used for electrospray at different flow rates according to the product sheet of the tapered emitter. The PCF emitters and tapered emitters were positioned about 2 mm relative to the MS orifice. Using a typical electrospray solution (1:1 of MeOH:$H_2O$), all emitters showed similar performance at moderate flow rate (e.g., 500 nL/min; see FIGS. 9*c* and 9*d*). At high flow rate (e.g., 1000 nL/min; FIGS. 9*a* and 9*b*) PCF emitters performed better than tapered emitters. At low nano-flow rate (e.g., 50 nL/min; FIGS. 9*e* and 9*f*), the 30 channel PCF emitter gave best sensitivity and stability, whereas the other PCF emitters were similar to the tapered emitter. FIG. 9*g* shows a comparison of electrospray stability and sensitivity of a CTMS-treated 30 channel PCF emitter (filled bars) and a tapered emitter (FS360-50-30) (hatched bars) obtained by spraying a 90% aqueous solution as a function of flow rate. As can be seen, the PCF emitter exhibited a dramatic increase in sensitivity at low flow rates (down to 10 nL/min), relative to the tapered emitter.

Figure 3A:
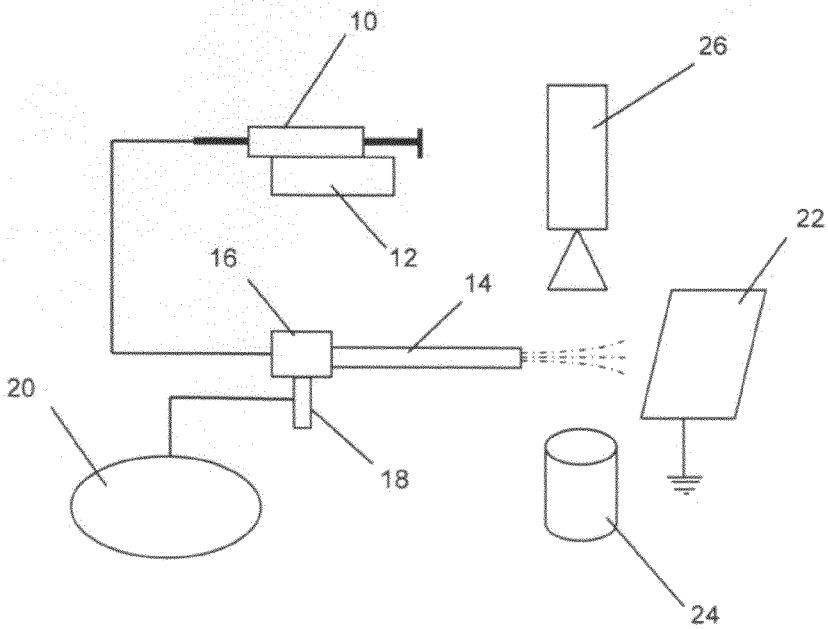
FIG. 3*a* is a schematic diagram showing the experimental set-up for off-line generation of electrosprays using a multi-channel PCF emitter.
Figure 3B:
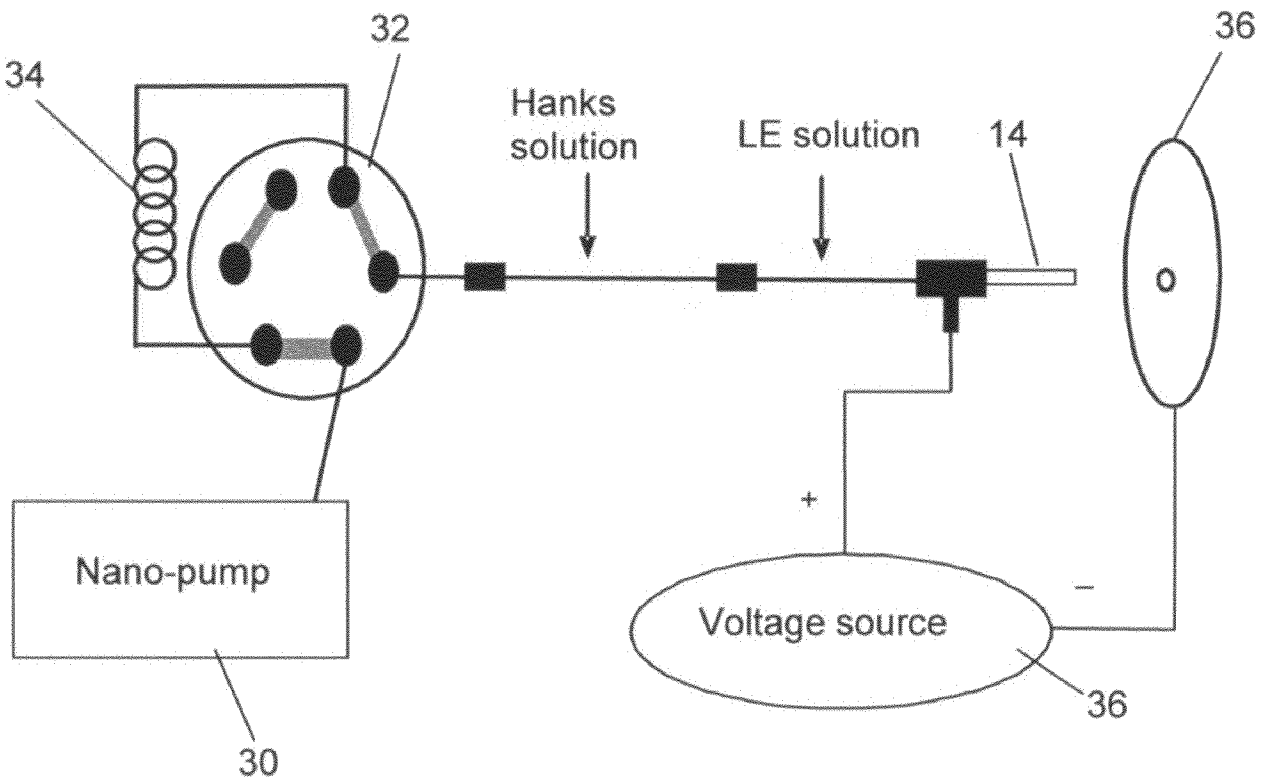
FIG. 3*b* is a schematic diagram showing the experimental setup used to evaluate resistance to clogging of a MSF emitter.
Figure 7:
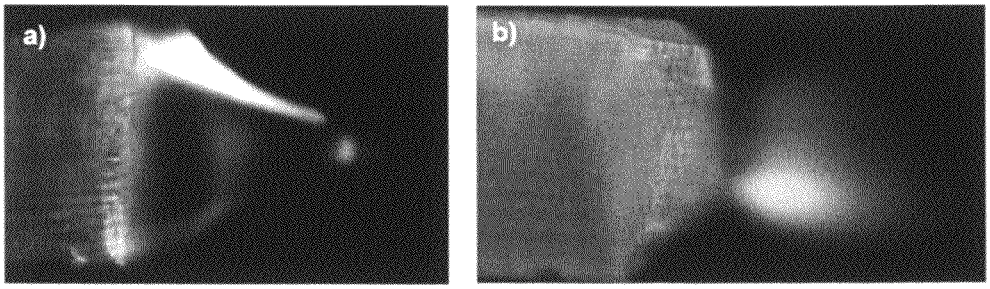
FIG. 7 shows photomicrographs of the multi-channel electrospray of a 30 channel PCF emitter functionalized with TMS, (a) at a flow rate of 300 nL/min, and (b) at a flow rate of 50 nL/min.

To visually demonstrate the tendency of the PCF multi-channel emitter to form multiple electrosprays, the electrospray resulting from the experimental set up shown in FIG. 3*a* was photographed. It can be seen from the photomicrograph of FIG. 7 that at 25 nL/min, there were multiple jets of mist, possibly emanating from multiple Taylor cones resulting from the multi-channel emitter. This result suggests that the formation of multiple Taylor cones at low flow rates contributes to the superior sensitivity of the multi-channel PCF emitter relative to the New Objective tapered emitter.

Other emitter performance indexes that were considered include working distance and resistance to clogging. The optimal working distance from the PCF emitter nozzles (e.g., to the MS inlet) was found to be about 0.5 to 1.5 cm, and this distance was consistent even at low flow rates, e.g., 20 nL/min. In contrast, it was found that the New Objective tapered emitter should be located much closer (e.g., 1 to 5 mm) to the MS orifice, which poses a risk of ion source contamination. Furthermore, the fact that multi-channel PCF emitters are not internally tapered makes them highly resistant to clogging compared to single channel tapered emitters. Indeed, because of their greater lifespan and reliability, multi-channel PCF emitters are well-suited for use in high throughput laboratories. A further advantage of multi-channel PCF emitters is that even at relatively high flow rates, there is less back pressure, relative to previously reported porous polymer monolith emitters[23].

Figure 8:
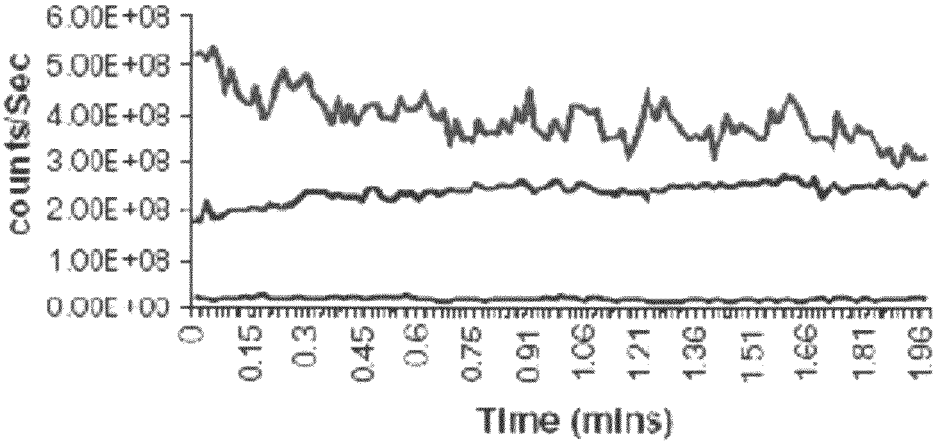
FIG. 8 shows a comparison of the stability of nanoelectrospray of trimethylsilane (TMS) modified multi-channel PCF emitters (top trace, 168 channels, F-20-CH3; middle trace, 30 channels, F-16-CH3) and a single channel tapered emitter (New Objective, bottom trace), spraying 1 μM leucine enkephalin (in 90% water, 10% acetonitrile, 0.1% HCOOH) at 100 nL/min.

The 30 channel PCF emitter may also be used for conventional LC separations, where ~1000 nL/min flow rates are typically used. At such flow rates, each individual nozzle would deliver about 30 nL/min, thus increasing desolvation, ionization efficiency, and matrix effects suppression; leading to increased sensitivity. While the multi-channel PCF emitter provides excellent performance with a standard MS inlet, use of a multi MS inlet and a more efficient electrodynamic ion funnel, which is tailored to accept the greater ion current of the emitter, might increase the transmission efficiency and hence further increase sensitivity. Use of PCFs with more channels, such as the 168 channel PCFs noted above, is expected to further improve performance, particularly at low flow rates. The TIC traces of FIG. 8 indicate that, like the 30 channel PCF emitter, the unmodified 168 channel PCF emitter had greater sensitivity than the single channel tapered emitter. Multi-channel PCF emitters are well-suited for coupling to microfluidic devices, whereby such monolithic platforms including PCF emitters would integrate separation and electrospray on a common capillary column.

The PCF emitter produces a spray from multiple channels covering large spaces (e.g., a total emitting surface diameter of 60 μm for a 30 channel PCF emitter and 173 μm for a 168 channel emitter). Larger emitting surface areas may affect the MS sampling efficiency resulting in lower ion currents. It is therefore expected that PCF emitters used in conjunction with an electrodynamic ion funnel would further increase sensitivity.

Figure 10A:
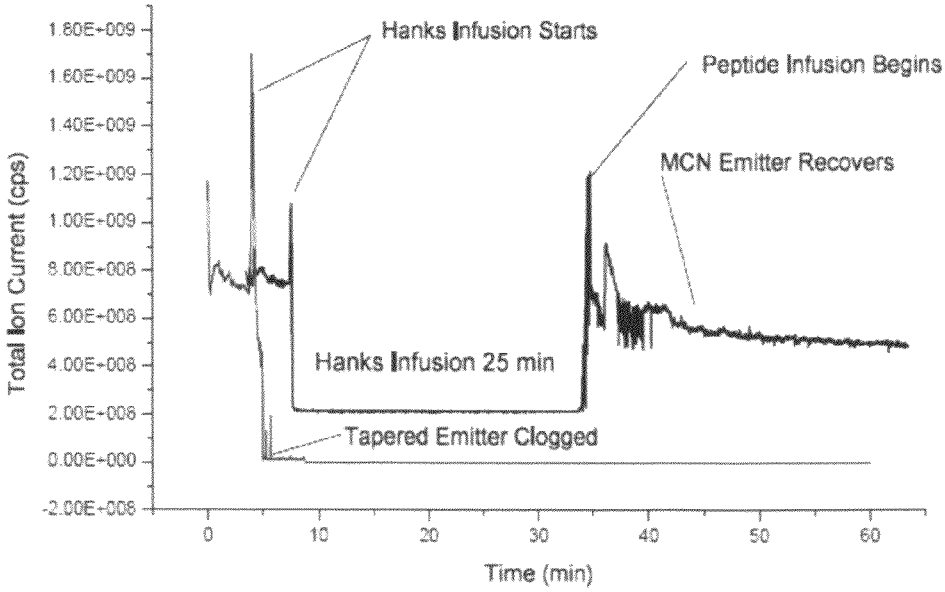
FIG. 10*a* shows a comparison of resistance to clogging of a 30 channel MSF emitter and a tapered emitter with a 5 micron tip aperture (FS360-50-30), obtained by infusing Hanks buffer.
Figure 10B:
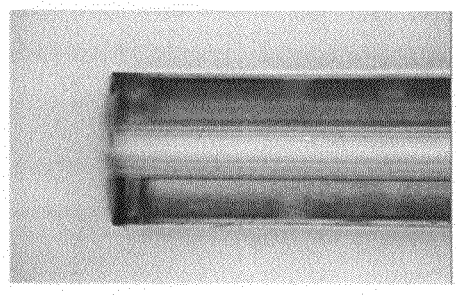
FIGS. 10*b* and 10*c* are photomicrographs of the 30 channel MSF emitter and the tapered emitter after the clogging experiment.
Figure 10C:
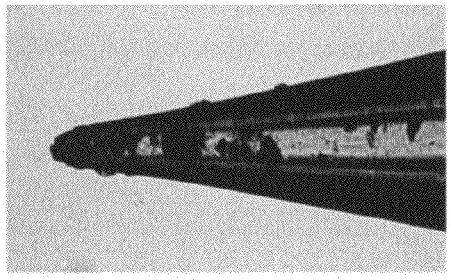

Multiple fluidic channels make MSF emitters more resistant to clogging. The clogging resistance of PCF emitters was evaluated by infusing Hanks solution, a highly concentrated nonvolatile salt mixture used for cell culturing. This method has been used by some manufacturers of mass spectrometers to assess emitter robustness to clogging. A commercial tapered emitter with a 5 μm tip aperture was used for a comparison with a 30 channel PCF emitter. Leucine enkephalin and Hanks solutions were sequentially infused through each of the emitters at 200 nL/min using the setup shown schematically in FIG. 3*b*. Both induced backpressure (time to clog) and the resulting mass spectra were monitored to gauge the relative robustness of each emitter type. With the continuous infusion of Hanks solution, the tapered emitter experienced a sharp rise in backpressure (>2000 psi) and was completely clogged in less than 4 minutes (see FIG. 10*c*), resulting in a complete loss of ion intensity. In contrast, the PCF emitter not only survived the clogging test after constantly infusing the Hanks solution for 25 minutes (FIG. 10*a*, 10*b*), but also demonstrated the capability to resume its normal electrospray performance, indicated by the recovered analyte signal. Although this is an extreme case, it demonstrates the relative robustness of the PCF emitter to clogging.

Figure 10D:
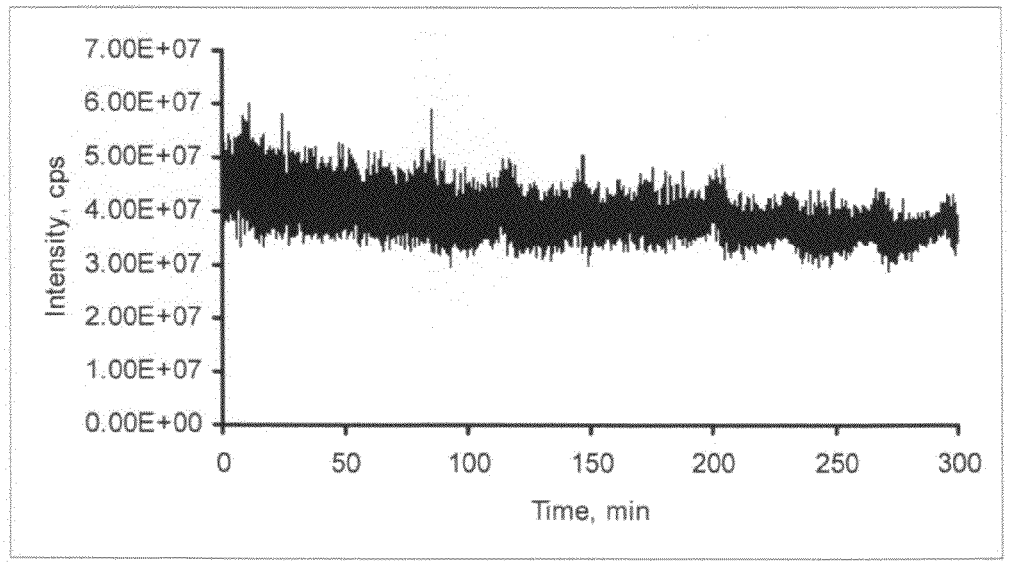
FIG. 10*d* shows the results of a longevity test on a 30 channel MSF emitter, obtained by infusing a solution of verapamil (0.6 μM) and leucine enkephalin (0.7 μM) in 50% MeOH with 0.2% acetic acid.

The robustness of a 30 channel PCF emitter was also tested by monitoring of spray stability of a verapamil and leucine enkephalin solution over 5 hours with a RSD of the acquired TIC at 11%. Sensitivity of the detection was maintained constantly through the 5 hour run period (see FIG. 10*d*).

Example 2

In MSF emitters prepared with a flat tip face, the spray from individual nozzles may coalesce, detracting from the multiple spray effects. This effect may be reduced by functionalizing the spray surface with a hydrophobic monolayer coating, such as chlorotrimethylsilane (CTMS). Whereas hydrophilic solvents are less likely to coalesce, the problem does persist. In this example each nozzle was raised above the surface of the MSF face, to promote individual spray from each nozzle. FIG. 11*a* shows a MSF emitter with a flat tip face, and FIG. 11*b* shows a MSF emitter with raised nozzles.

To raise the nozzles of the emitter as shown in FIG. 11*b*, an initial investigation was carried out using wet etching with ammonium bifluoride. A 54-channel MSF was etched for three hours while flowing water through the channels. However, too much of the tip face was etched away, such that the nozzle structure was not maintained, and Taylor cone segregation was unlikely even at lower etching times. This result indicated the need for another material, resistant to the etchant, to maintain the channel/nozzle structure.

A polymer layer was formed on the inside walls of each channel prior to etching. The polymer was prepared from 50% polystyrene/divinylbenzene (adapted from Luo et al. 2007). When the polymer-coated MSF was etched, the polymer tubes protruded from the face of the MSF. This allows for a greater separation of Taylor cone sprays. The procedure for preparing the polymer coated MSF emitters is given below. This procedure was used for a 168 channel MSF and may easily be adapted for other MSFs.

1. Cut a 64 cm length of MSF fibre.
2. Pretreat the MSF:
   a. Pump a solution of 50% DDI water/30% glacial acetic acid/20% 3-(trimethoxysilyl)propyl methacrylate through the fibre for 30 minutes at 20 μL/min with syringe pump.
   b. Place ends of the fibre in the same solution overnight.
3. Flush the MSF:
   a. Cut about 4 cm off the ends of the fibre.
   b. Pump 95% V/V acetonitrile in water through the fibre for 40 minutes at 30 μL/min using HPLC pump.
4. Polymerization:
   a. Set oven to 74° C.
   b. Prepare polymerization solution:
      i. 5 mg AIBN;
      ii. 600 μL EtOH (anhydrous);
      iii. 200 μL DVB;
      iv. 200 μL Styrene.
   c. Thermally initiated polymerization:
      i. Cut fibre in half
      ii. Pump polymer solution into first half of fibre for 15 minutes from appearance of first drop using syringe pump.
      iii. Put the fibre in the oven; cap ends with parts of GC septa.
      iv. Repeat for second half of fibre.
      v. Leave in oven overnight.
5. Final flushing:
   a. Flush each half of fibre with 95% acetonitrile for 20 minutes using a HPLC pump.
6. Etching:
   a. Cut a 7 cm length of the polymer coated MSF.
   b. Place 1 cm of the end in toluene for 4 minutes to remove polymer coating.
   c. Place tip in saturated ammonium bifluoride for 3-15 minutes.
   d. Place tip in water and flow water through the fibre at 0.5 μL/min for 25 minutes FIGS. 12*a* and *b* show SEM images of such an emitter with 168 channels that was etched for 12 minutes. The figures show that each channel of the MSF includes a polymer nozzle that stands ~5 μm above the emitter face. In addition, because the polymer material is hydrophobic, and each polymer channel is physically separated from material of the tip face, further hydrophobic treatment, such as with CTMS, is not necessary to prevent coalescence of the electrospray.

Experiments compared the performance of 54-channel, 84-channel, and 168-channel "stock" MSF emitters (i.e., emitters without polymer coating and etching), a 168-channel polymer coated, etched MSF emitter (also referred to as "etched"), and two capillary emitters (an 8 μm uncoated Picotip (New Objective) emitter, and a 30 μm Picotip emitter). Each emitter was secured 5 mm from a gold-coated wire mesh. A T-junction and Tricep high voltage power supply were used to apply a voltage to the spray solvent via a platinum wire inserted into the T. A Keithley picoammeter was used to monitor current. Tests were run to measure the spray stability and current of each emitter. Voltages spanned 2000 to 4000 V, and solvent composition spanned 100% Acetonitrile to 100% Water with 0.1% formic acid.

Relative to the other emitters tested, the polymerized and etched 168-channel emitter greatly increased the spray stability over all conditions, even relative to the 168-channel stock emitter. The polymerized and etched emitter was also more capable of stable spray at higher flow rates than all other nozzles, including the 8 μm and 30 μm Picotip capillary emitters. FIGS. 13*a-d* show performance of the emitters arranged by solvent composition. It can be seen that the 168-channel etched emitter performed best relative to the other emitters at highly aqueous solvent compositions, which is likely due to the hydrophobic nature of the polymer coating.

Initial tests were performed on a 168-channel polymer coated MSF emitter that was prepared without etching. Preliminary results of spray current and stability indicate performance similar to that of the 168-channel stock MSF emitter. This result suggests that the etching step contributes to the superior performance of this emitter.

Figure 14:
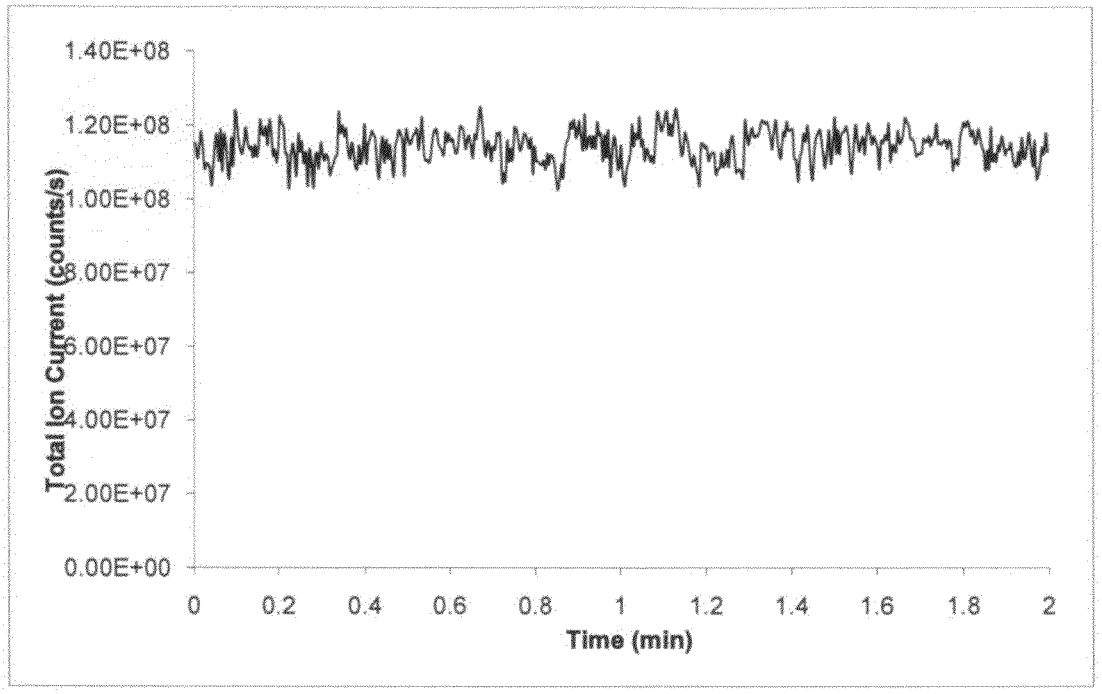
FIG. 14 is a plot showing total ion current as a function of time from a mass spectrometer for an etched emitter using 50% ACN/water with 0.1% formic acid, 200 nL/min, 3.4 kV, at 1 cm working distance.

An initial test of the 168-channel polymer coated etched MSF emitter was performed on a mass spectrometer. A total ion current trace (500-600 m/z) for the direct infusion of 5 μM leucine enkephalin in 50% ACN/water with 0.1% formic acid is shown in FIG. 14. For this trace, the flow rate was 200 nL/min and the emitter was placed 1 cm from the MS orifice, with an applied potential of 3400 V. Under the same conditions, a 15 μM tapered tip has a TIC ~$6.5\times10^7$ counts/s (using 2200 V) and a CTMS-treated 54-channel stock MSF emitter gives a TIC ~$9.5\times10^7$ counts/s (using 3200 V). For the 2-minute trace in FIG. 14, the relative standard deviation in signal was 3.8%, indicating very good performance relative to tapered emitters and MSF emitters without polymers and etching.

Figure 12B:
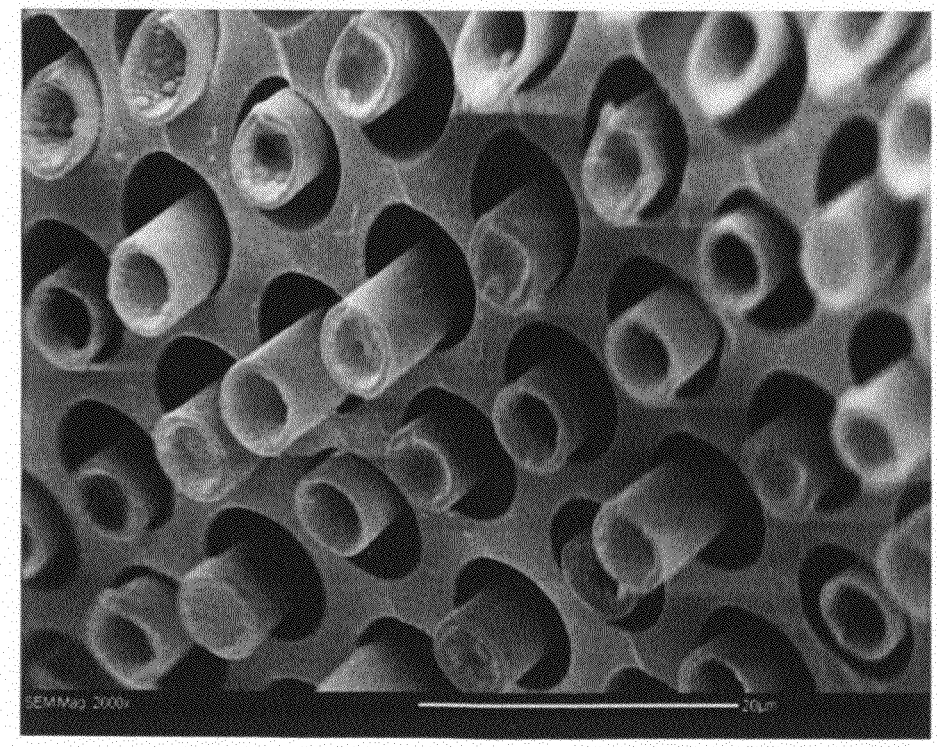
Figure 13A:
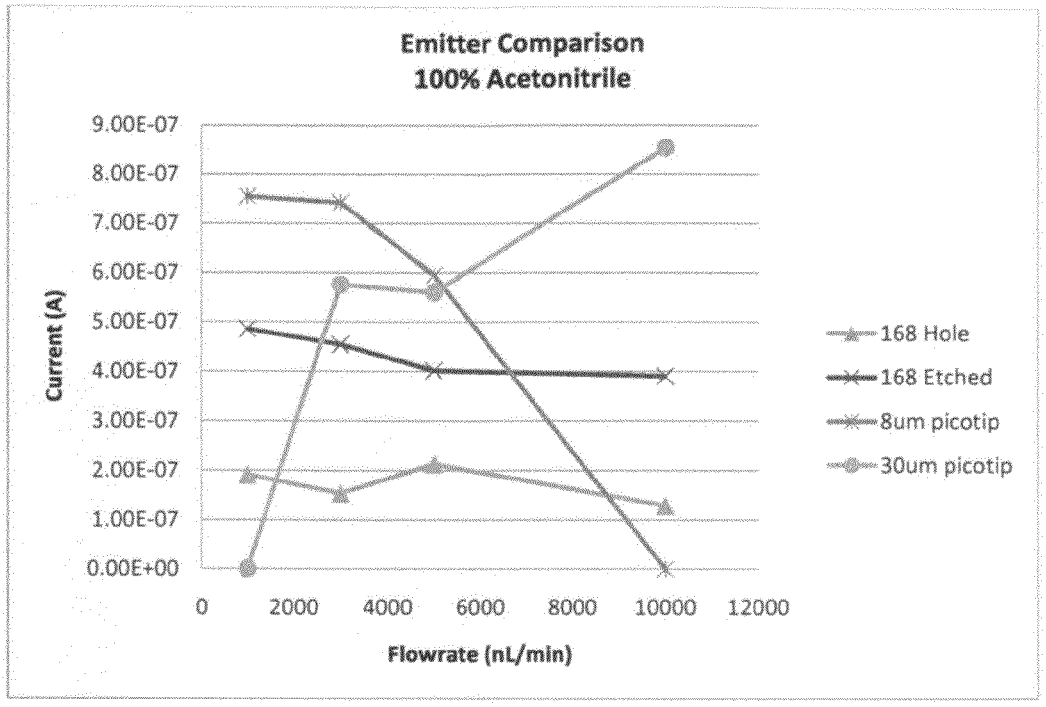
FIGS. 13*a* to 13*d* are plots showing spray current as a function of flow rate for a 168 channel MSF emitter prepared with polymer coating of the channels and etching, relative to performance of other emitters, for various concentrations of acetonitrile.
Figure 13B:
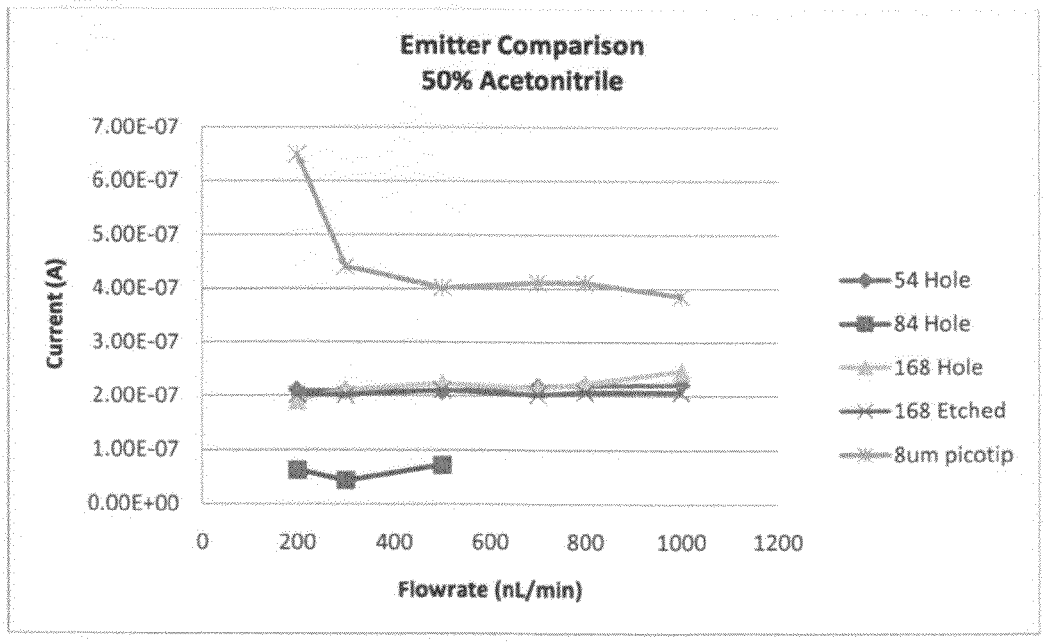
Figure 13C:
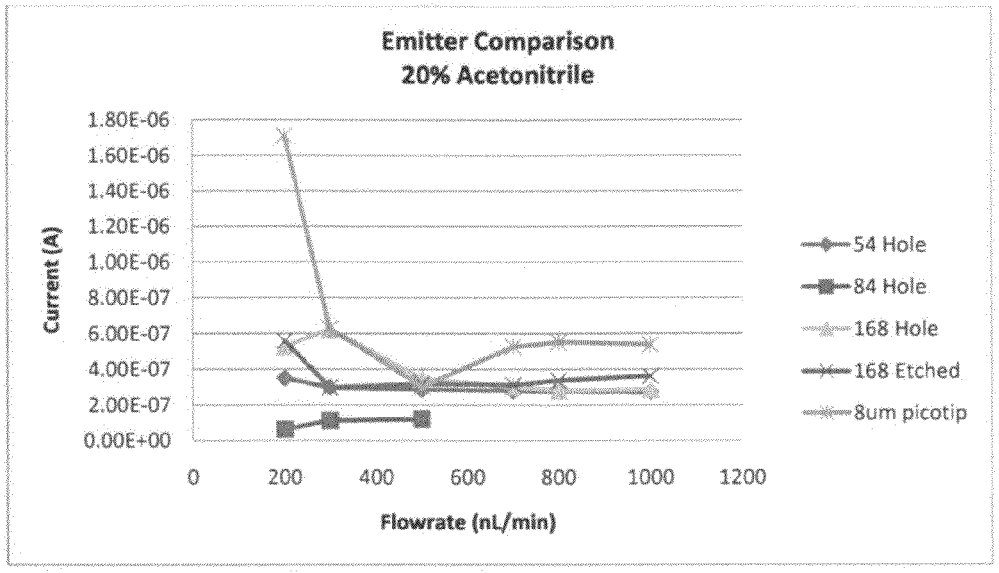
Figure 13D:
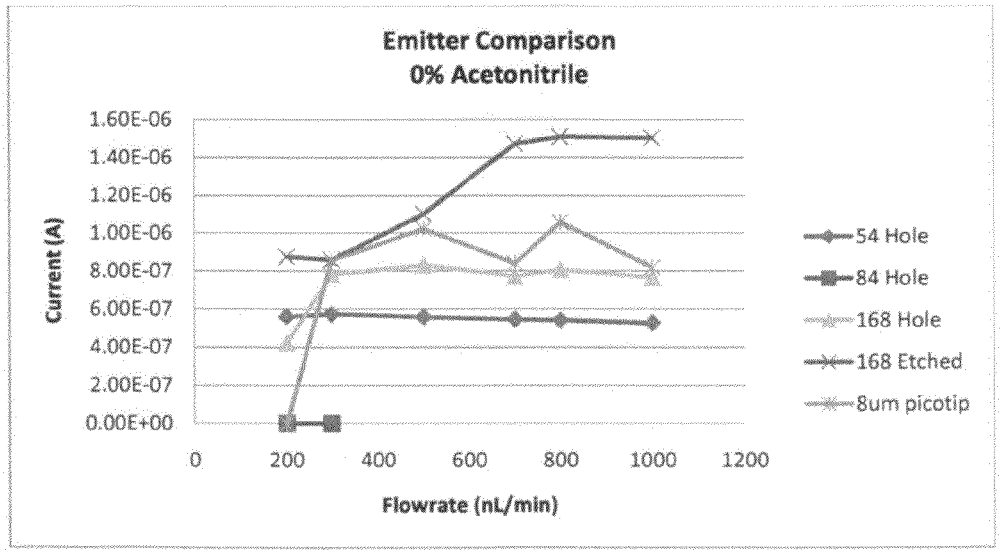

It is expected that etching with HF or another etchant, rather than ammonium bifluoride, may produce nozzles with less expansion of the MSF channels diameters (i.e., with less loss of the matrix material surrounding the nozzles (see FIG. 12*b*). This may lead to increased spray stability.

Example 3

In certain applications it is desirable to have a multi-channel electrospray emitter that can produce multiple electrosprays (e.g., a distinct Taylor cone produced by each nozzle). However, as noted above, in MSF emitters prepared with a flat tip face, the spray from individual nozzles may coalesce, detracting from the multiple electrospray (ME) spray effect. In this example multiple electrosprays were produced using emitters with smaller numbers of nozzles.

Emitters were prepared from a two channel pulled glass MSF and one, three, and nine channel polycarbonate MSFs.

Figure 15A:
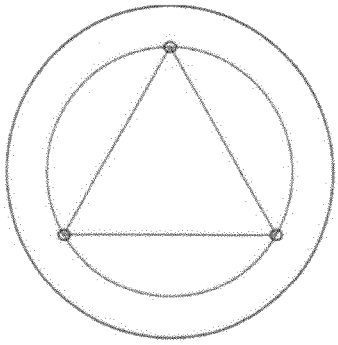
FIGS. 15*a* and 15*b* are diagrams showing arrangement of nozzles for three and nine channel polycarbonate MSF emitters.
Figure 15B:
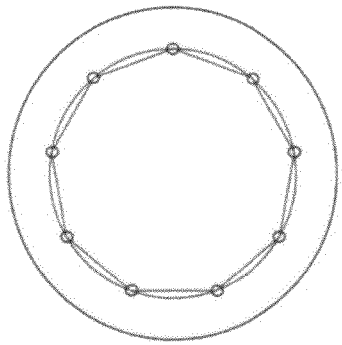

The arrangements of the channels/nozzles in the three and nine channel MSFs are shown in FIGS. 15*a* and 15*b*.

Tests were run to measure the spray stability and current of two channel emitters prepared from glass MSF, and one, three, and nine channel emitters prepared from polycarbonate MSF. The emitter was placed 2-3 mm from a gold coated wire mesh. A custom pump (Upchurch Scientific, Oak Harbor, Washington, U.S.A.) delivered the spray solvent. A T-junction was used to apply a voltage in the spray solvent. Voltages spanned 2000V to 4000V, and the spray solvent was kept constant at a 50:50 mixture of water and methanol with 1% acetic acid added as an ion source. Flow rates varied from 30 to 300 nL/min. Emitters were viewed and photographed through a Nikon Eclipse Ti-S inverted fluorescence microscope (Nikon Canada, Mississauga, ON, Canada). Excitation was provided by an X-Cite Series 120Q light source (Exfo Photonic Solutions Inc., Quebec City, QC, Canada) with a 450-490 nm excitation filter provided with the microscope. Images were captured by a Nikon DS digital camera.

The two channel glass MSF (from Friedrich & Dimmock, Inc., Millville, N.J., U.S.A.) had channels of 25 μm diameter, and the fibre diameter was 157 μm. The fibre was pulled under heat from a propane torch and gravity-assisted force from a 23 g weight. After pulling, each channel diameter was about 5 μm, and the two channels were spaced about 30 μm apart.

The two channel glass emitter produced two separate Taylor cones. The two sprays were not parallel to the fibre, but pointed away from one another. This was due to the sprays being positively charged, therefore repelling each other. Because these emitters would not fit in standard fittings due to their large diameter on the non-pulled end, solvent pumping was done by hand with a syringe pump. Consequently, the actual flow rate was not known precisely, but was approximately 200 nL/min. The applied voltage of 4000V was high for standard ESI; however, it was found to be necessary to achieve multiple electrospray. At lower voltages, the spray would coalesce into one larger cone, or not form a cone at all. The observed spray current was very low and unstable, fluctuating between approximately 3-10 nA. An attempt to improve these points was made by treating the emitters for 1 hour or 16 hours in a 20:80 chlorotrimethylsilane (CTMS): toluene solution, but no gains were observed.

For the polycarbonate emitters, three and nine channel polycarbonate MSFs (Kiriama Pty Ltd., Sydney, Australia) were used. The three channel fibre had a diameter of 615 μm and channel diameter of 8 to 9 μm. The nine channel fibre had a diameter of 630 μM and channel diameter of 9 to 11 μm. For the three channel fibre, the channels were equally spaced on a 415 μm diameter about the central axis of the fibre. For the nine channel fibre, the channels were equally spaced on a 430 μm diameter about the central axis of the fibre. Diagrams of the fibre cross sections are shown in FIGS. 15*a* and 15*b*.

Figure 16:
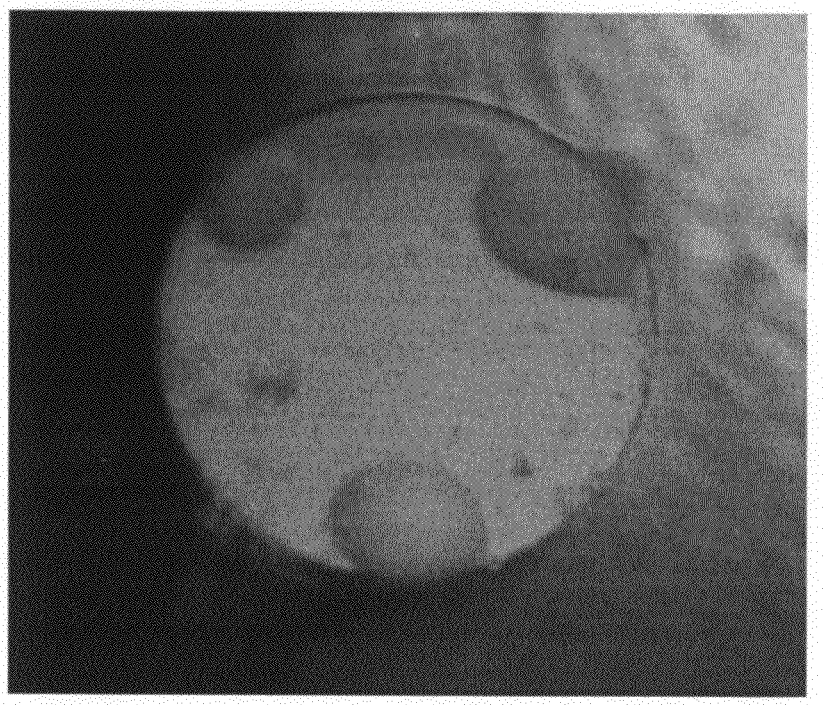
FIG. 16 is a photomicrograph showing an end view of a three channel polycarbonate MSF emitter producing multi-electrospray.

The three and nine channel polycarbonate were able to produce multiple electrosprays. The three channel polycarbonate emitter produced three distinct Taylor cones that were very stable (~30 minutes), shown in end view in FIG. 16, using a voltage of 3500V to 4000V, and a flow rate of 50 nL/min+/−10 nL/min. It was noted that the emitter face should be dry in order to achieve ME. A wet emitter face causes the liquid streams to coalesce, resulting in a single Taylor cone.

A protocol to achieve ME may be as follows:

Set pump at desired flow rate

Turn off voltage

Dry the end of the MSF emitter with a dabber or compressed air

Wait until small droplets form around each nozzle, then turn on voltage

Figure 17:
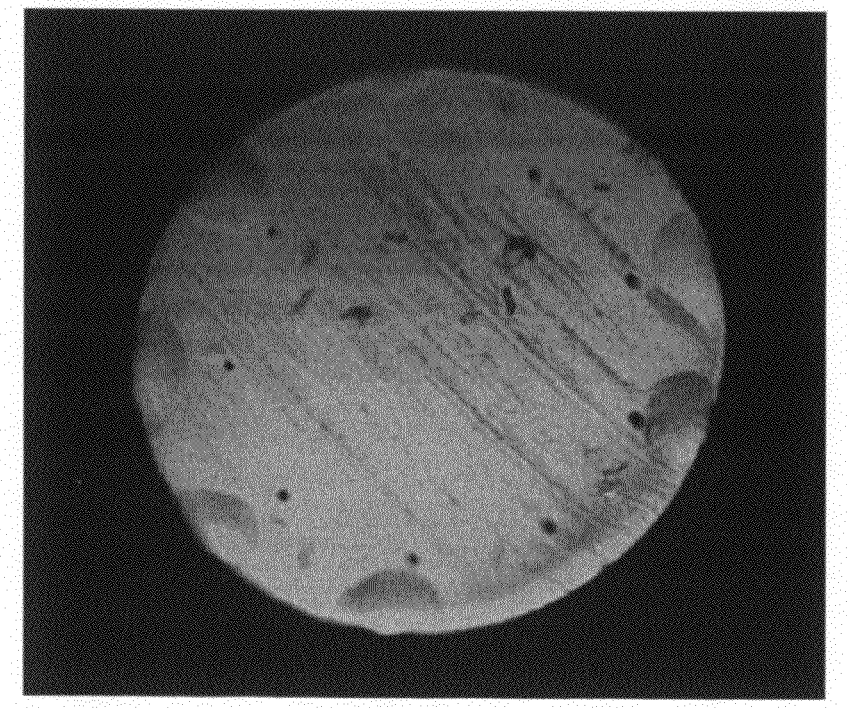
FIG. 17 is a photomicrograph showing an end view of a nine channel polycarbonate MSF emitter producing multi-electrospray.

Similar experiments were performed on the nine channel polycarbonate emitter, using a voltage of 3500V to 4000V and flow rate of about 75 nL/min to 150 nL/min for stable ME. FIG. 17 shows an end view of the nine channel emitter producing ME. From FIG. 17 it can be seen that the separate Taylor cones did not form directly over the nozzles, but rather stabilized on the edge of the fibre. This was due to the fact that each cone is positively charged, such that the cones repel each other.

To enhance the ability of the emitters to produce ME, hydrophobicity of the polycarbonate material was increased. The increased hydrophobicity reduces wetting of the emitter face by the spray solvent, so that solvent exiting each nozzle forms a Taylor cone.

$CF_4$ plasma ionization was carried out to increase hydrophobicity of the polycarbonate. Investigations were performed on a Harrick PDC-001 plasma ionizer with $CF_4$ (Sigma-Aldrich) to determine an optimal procedure for surface modification. 2 cm×2 cm plates of polycarbonate cleaned with methanol were subjected to various lengths of ionization at 29.6 W and 400 m Torr. The contact angle of water as well as the standard solvent solution of 50:50 water: methanol and 1% acetic acid were measured. The contact angle of both water and the spray mixture increased asymptotically with an increase in treatment time. Based on these investigations, the PC MSFs were treated for 5 minutes to give a spray solvent contact angle improvement of approximately 20°, i.e., from 65° to 85°. Further treatment tended to warp the fibre under the heat of the plasma chamber.

Figure 18:
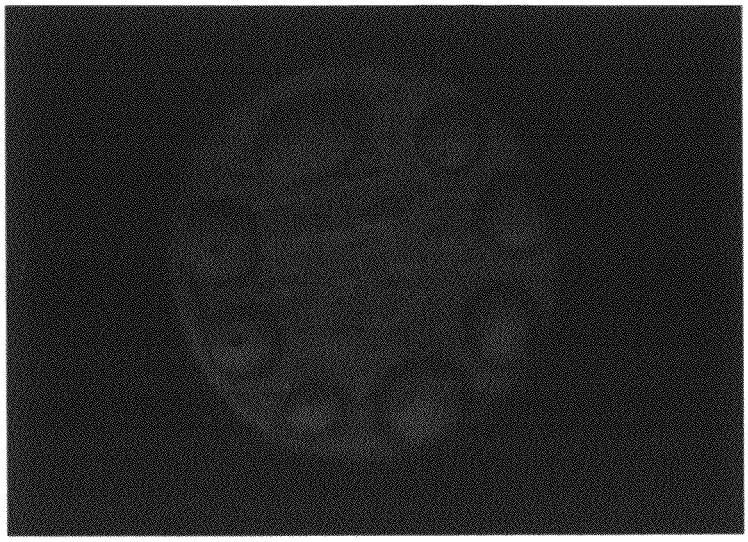
FIG. 18 is a photomicrograph showing an end view of a nine channel modified polycarbonate MSF emitter producing multi-electrospray.

The $CF_4$-modified fibres exhibited the desired reduction in required spray voltage, while optimal flow rates remained the same. Voltages of 1800V to 3000V were found to be suitable for the modified fibres. FIG. 18 shows an end view of the spray of such a modified fibre. As can be seen from FIG. 18, an emitter prepared from a modified fibre produces better defined Taylor cones, and the cones form over the nozzles from which they are fed. While the individual sprays are still repelled from each other, it is to a lesser extent, likely because the required applied voltage is considerably lower.

Figure 19:
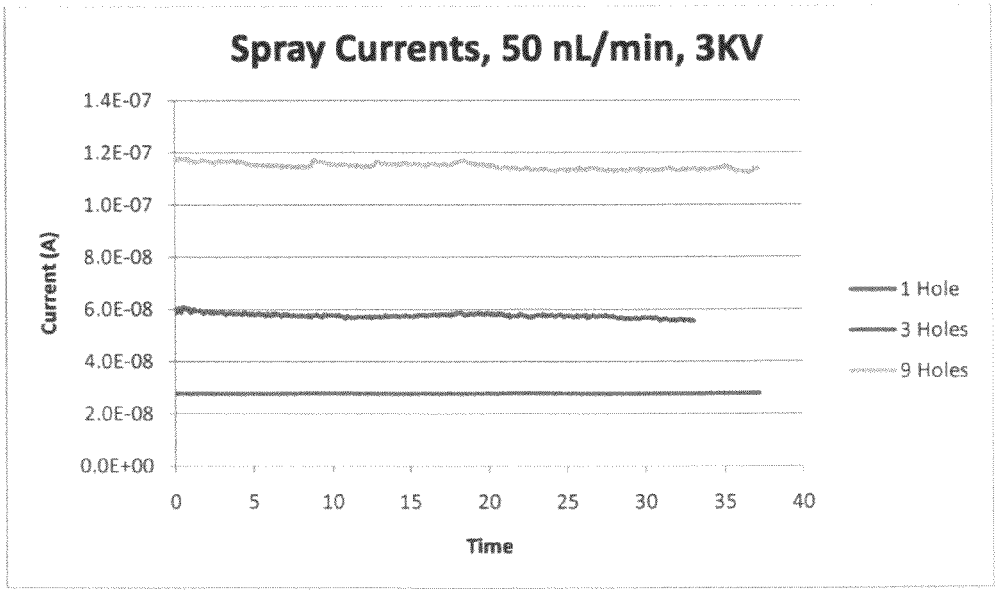
FIG. 19 is a plot showing stable spray current of one, three, and nine channel polycarbonate MSF emitters.
Figure 20:
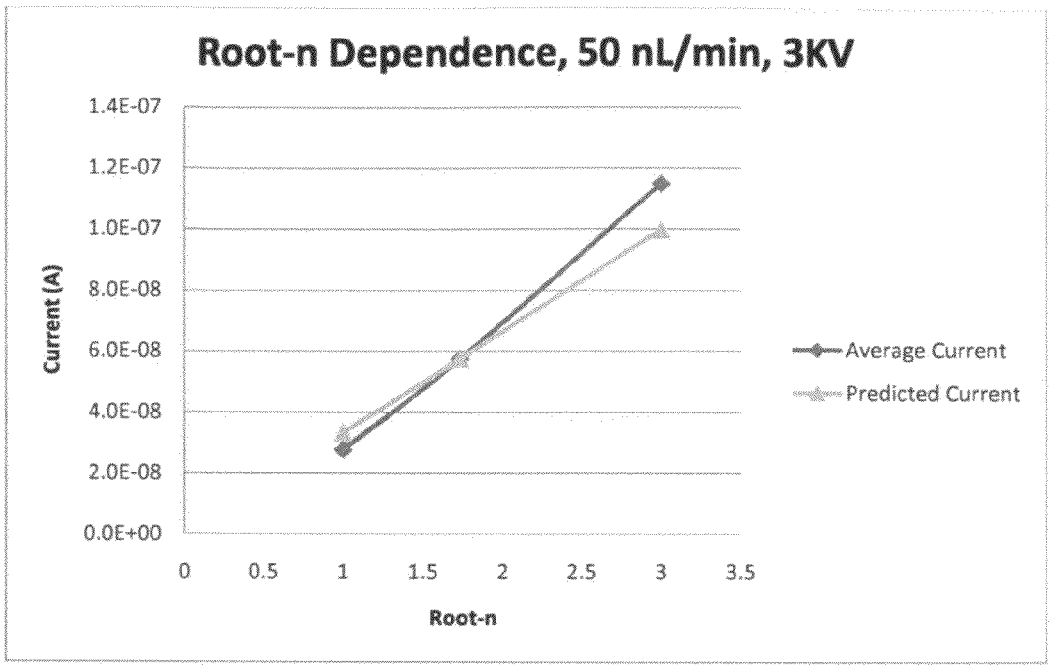
FIG. 20 is a plot showing root n dependence of spray current for one, three, and nine channel polycarbonate MSF emitters.

Since ME was reliably obtained with three and nine channel emitters, the validity of Smith's[31] $\sqrt{n}$ theory, which states that the spray current of ME increases with the square root of the number of simultaneous Taylor cones. To obtain an additional data point, a single channel PC MSF emitter was prepared by melting closed two of the channels of a three channel PC MSF emitter with a hot needle. Performance of the single channel emitter was verified under a microscope, wherein there was no bleed-off of solvent around the melted area. A single set of conditions under which all three fibres would spray was required in order to make a comparison and evaluate the $\sqrt{n}$ theory. An acceptable condition was found to be at a potential of 3000V and a flow rate of 50 nL/min using the standard solvent. Each emitter was set up in turn in the same apparatus under these conditions, and a steady flow rate and spray current was achieved, at which point a 3 minute trace of spray current was obtained. These data are presented in FIGS. 19 and 20. From FIG. 20 it can be seen that the spray currents from the one, three, and nine channel PC emitters during ME closely conform to the $\sqrt{n}$-dependence predicted by Smith[31], with RSDs less than 1.5% for all emitters.

Further enhancements in performance are achieved using emitters with a small number of channels/nozzles (e.g., 3 to 12, or 3 to 20 channels), where the emitters are modified so as to elevate the nozzles above the emitter face, as described above (i.e., as in FIG. 11(*b*)). In particular, an MSF made from silica-based material (such as glass) is suitable for such an ME emitter.

EQUIVALENTS

While the invention has been described with respect to illustrative embodiments thereof, it will be understood that various changes may be made to the embodiments without departing from the scope of the invention. Accordingly, the described embodiments are to be considered merely exemplary and the invention is not to be limited thereby.

REFERENCES (1) Dole, M.; Mack, L. L.; Hines, R. L.; Mobley, R. C.; Ferguson, L. D.; Alice, M. B. *J. Chem. Phys.* 1968, 49, 2240-2249.

(2) Fenn, J. B.; Mann, M.; Meng, C. K.; Wong, S. F.; Whitehouse, C. M. *Science* 1989, 246, 64-71

(3) Yamashita, M.; Fenn, J. B. *J. Phys. Chem.* 1984, 88, 4451-4459.

(4) Busch, K. L.; Cooks, R. G. *Science* 1982, 218, 247-254.

(9) Wilm, M.; Mann, M. *Anal Chem* 1996, 68, 1-8.

(10) Martin, S. E.; Shabanowitz, J.; Hunt, D. F.; Marto, J. A. *Anal. Chem.* 2000, 72, 4266-4274.

(11) Schmidt, A.; Karas, M.; Dulcks, T. *J. Am. Soc. Mass Spectrom.* 2003, 14, 492-500.

(12) Smith, D. R.; Moy, M. A.; Dolan, A. R.; Wood, T. D. *Analyst* 2006, 131, 547-555.

(13) Zampronio, C. G.; Giannakopulos, A. E.; Zeller, M.; Bitziou, E.; Macpherson, J. V.; Derrick, P. J. *Anal. Chem.* 2004, 76, 5172-5179.

(17) Kelly, R. T.; Page, J. S.; Tang, K.; Smith, R. D. *Anal. Chem.* 2007, 79, 4192-4198.

(18) Kelly, R. T.; Page, J. S.; Zhao, R.; Qian, W. J.; Mottaz, H. M.; Tang, K.; Smith, R. D. *Anal. Chem.* 2008, 80, 143-149.

(19) Kim, W.; Guo, M.; Yang, P.; Wang, D. *Anal. Chem.* 2007, 79, 3703-3707.

(20) Le Gac, S.; Rolando, C.; Arscott, S. *J. Am. Soc. Mass Spectrom.* 2006, 17, 75-80.

(21) Le Gac, S.; Arscott, S.; Rolando, C. *Electrophoresis* 2003, 24, 3640-3647.

(22) Tang, K.; Lin, Y.; Matson, D. W.; Kim, T.; Smith, R. D. *Anal. Chem.* 2001, 73, 1658-1663.

(23) Koerner, T.; Turck, K.; Brown, L.; Oleschuk, R. D. *Anal. Chem.* 2004, 76, 6456-6460.

(24) Bedair, M. F.; Oleschuk, R. D. *Anal. Chem.* 2006, 78, 1130-1138.

(25) Koerner, T.; Xie, R.; Sheng, F.; Oleschuk, R. *Anal. Chem.* 2007, 79, 3312-3319.

(26) Russell, P. S. J. *Science,* 2003, 299, 358-362.

(27) Sun, Y.; Kwok, Y. C.; Nguyen, N. T. *Electrophoresis* 2007, 28, 4765-4768.

(28) Kriger, M. S., Cook, K. D., Ramsey, R. S. Durable gold-coated fused silica capillaries for use in electrospray mass spectrometry. *Anal. Chem.* 1995, 67, 385-389.

(29) Barnidge, D. R., Nilsson, S., Markides, K. E., Rapp, H., Hjort, K. Metallized sheathless electrospray emitters for use in capillary electrophoresis orthogonal time-of-flight mass spectrometry. *Rapid Commun. Mass Spectrum* 1999, 13, 994-1002.

(30) Luo Q., Yue G., Valaskovic G. A., Gu Y., Wu S.-L., Karger B. L. *Anal. Chem.* 2007, 79, 6174-6181.

(31) Smith, R., Tang, K., Lin, Y., Matson, D., & Kim, T. Generation of Multiple Electrosprays Using Microfabricated Emitter Arrays for Improved Mass Spectrometric Sensitivity. *Analytical Chemistry* 2001, 73, 1658-1663.

The invention claimed is:

1. An electrospray emitter comprising:

a microstructured fibre;

a plurality of capillaries formed through the microstructured fibre;

a coating material disposed on inside walls of the capillaries, the coating material projecting outwardly from a face of the electrospray emitter so as to provide a plurality of nozzles, each nozzle corresponding to a capillary;

wherein each nozzle is located in a depression in the face of the electrospray emitter.

2. The electrospray emitter of claim 1, wherein the capillaries are arranged in a substantially parallel relationship within the microstructured fibre.

3. The electrospray emitter of claim 1, wherein the microstructured fibre comprises a photonic crystal fibre.

4. The electrospray emitter of claim 1, wherein the coating material disposed on inside walls of the capillaries is a polymer.

5. The electrospray emitter of claim 4, wherein the polymer is a divinylbenzene (DVB) material selected from polystyrene-divinyl benzene, a DVB homopolymer, DVB-vinylpyridine, DVB-ethylene glycol dimethacrylate (EDMA), and DVB-acrylonitrile, or a polymer selected from methyl, butyl, or stearyl methacrylate-EDMA, polyacrylamide-bisacrylamide, cyclodextrin, polyurethane, epoxy, polyvinyl alcohol (PVA), polyvinyl pyrrolidone (PVP), a charged polymer, and polyethyleneimine (PEI).

6. The electrospray emitter of claim 1, wherein the number of nozzles is from 2 to 200.

7. The electrospray emitter of claim 1, wherein the electrospray emitter is used with a mass spectrometer.

8. A system for electrospray ionization of molecules, comprising the electrospray emitter of claim 1.

9. The system of claim 8, further comprising a mass spectrometer.

10. A method for producing an electrospray of a solution, comprising:

applying the solution to the electrospray emitter of claim 1; and applying a potential difference to the electrospray emitter; wherein an electrospray of the solution is produced.

* * * * *